US011684130B2

(12) United States Patent
Atlas

(10) Patent No.: US 11,684,130 B2
(45) Date of Patent: Jun. 27, 2023

(54) EXPANDABLE BAG AND AN APPARATUS FOR EXPANDING A BAG

(71) Applicant: ANYVENTION LTD., Shoham (IL)

(72) Inventor: Yitzhak Atlas, Shoham (IL)

(73) Assignee: ANYVENTION LTD., Shoham (IL)

( * ) Notice: Subject to any disclaimer, the term of this patent is extended or adjusted under 35 U.S.C. 154(b) by 246 days.

(21) Appl. No.: 17/021,537

(22) Filed: Sep. 15, 2020

(65) Prior Publication Data

US 2021/0085046 A1 Mar. 25, 2021

Related U.S. Application Data

(63) Continuation-in-part of application No. PCT/IL2019/050277, filed on Mar. 13, 2019.

(30) Foreign Application Priority Data

Mar. 15, 2018 (IL) ..... 258144

(51) Int. Cl.

| | |
|---|---|
| ***A45C 7/00*** | (2006.01) |
| ***A45C 5/03*** | (2006.01) |
| ***A45C 5/14*** | (2006.01) |
| ***A45C 5/02*** | (2006.01) |

(52) U.S. Cl.

CPC ..... *A45C 7/0022* (2013.01); *A45C 5/02* (2013.01); *A45C 5/03* (2013.01); *A45C 5/14* (2013.01)

(58) Field of Classification Search

CPC ..... A45C 7/0022; A45C 5/02; A45C 5/03; A45C 5/14

USPC ..... 190/103

See application file for complete search history.

(56) References Cited

U.S. PATENT DOCUMENTS

| | | | | | |
|---|---|---|---|---|---|
| 1,573,721 | A * | 2/1926 | Loeffler | A45C 7/0036 | 220/8 |
| 2,806,563 | A * | 9/1957 | Einhorn | A45C 7/0036 | 190/107 |
| 2,972,430 | A | 2/1961 | Johnson | | |
| 3,335,827 | A * | 8/1967 | Hofferbert | B29C 70/28 | 190/125 |
| 4,361,215 | A * | 11/1982 | Sawai | A45C 7/0027 | 190/103 |
| 4,726,486 | A * | 2/1988 | Masuda | B65D 90/021 | 220/6 |
| 5,251,731 | A * | 10/1993 | Cassese | A45C 7/0036 | 190/103 |
| 7,232,018 | B1 | 6/2007 | Salander | | |

(Continued)

FOREIGN PATENT DOCUMENTS

| | | |
|---|---|---|
| GB | 2490164 A | 10/2012 |
| WO | 2019/175872 A1 | 9/2019 |

OTHER PUBLICATIONS

International Search Report for PCT/IL2019/050277, dated Jun. 10, 2019 (4 pages).

(Continued)

*Primary Examiner* — Jennifer Robertson
*Assistant Examiner* — Jessica Kavini Tamil
(74) *Attorney, Agent, or Firm* — Roach, Brown, McCarthy & Gruber, P.C.; Kevin D. McCarthy

(57) ABSTRACT

The present invention relates to a bag capable of being expanded by mechanical manipulation of a plurality of collapsible rigid walls and temporary fixation thereof using a support element connected thereto.

10 Claims, 20 Drawing Sheets

(56) References Cited

U.S. PATENT DOCUMENTS

| | | | | |
|---|---|---|---|---|
| 7,874,409 | B1 | 1/2011 | Lakhal | |
| 11,044,973 | B1 * | 6/2021 | Easterwood | A47G 9/10 |
| 2004/0020732 | A1 | 2/2004 | Chen | |
| 2005/0268622 | A1 | 12/2005 | Krieger | |
| 2006/0070837 | A1 * | 4/2006 | King | A45C 7/0022 190/105 |
| 2011/0048881 | A1 | 3/2011 | Wang | |
| 2015/0327639 | A1 * | 11/2015 | Antonelli | A45C 7/0022 190/18 A |

OTHER PUBLICATIONS

International Preliminary Report on Patentability for PCT/IL2019/050277, dated Jul. 14, 2020 (12 pages).
Written Opinion of International Searching Authority for PCT/IL2019/050277, dated Jun. 10, 2019 (6 pages).

* cited by examiner

EXPANDABLE BAG AND AN APPARATUS FOR EXPANDING A BAG

FIELD OF THE INVENTION

The invention relates to traveling and/or storing equipment. More particularly, the invention relates to carrier bags, specifically with regard to methods and devices for mechanically expanding bags.

BACKGROUND OF THE INVENTION

There are many types and sizes of traveling bags, starting from small hand-bags, up to large suitcases, but sometime there is a need for a size-adjustable bag in order to make new room for additional content.

According to the prior art, there are some methods for enlarging the size of a suitcase. Many expandable objects get their expansion ability from telescopic parts that are combined with each other and are suitable to be pulled out, to form a new and larger structure. As described in U.S. Pat. No. 7,874,409 and US2011/0048881A1, a suitcase provided with a telescopic frame is adjustable, but such mechanism suffers from abrasion of the telescopic parts, when sliding one inside the other, and the frame is under constant pressure and bending stress that can eventually cause the breakage of the frame.

Other solutions, such as are disclosed in U.S. Pat. No. 2,806,563 and GB2490164A, include a collapsible receptacle capable of being brought from an expanded configuration to a collapsed configuration. This solution is not suitable for cases in which the collapsible receptacle is coupled to another receptacle (e.g. a bag) inasmuch as in its expanded configuration the collapsible receptacle is unable to withstand the weight of the other receptacle and contents thereof.

Furthermore, many of the prior art solutions provides volume expansions which distances the center of gravity of the expended receptacle from its original supported position, hence reducing the stability of receptacle and bringing frustration to travelling passengers who must keep a hand on their luggage, or lift it back on its wheels many times.

Therefore, there is a need for an expandable bag, the expanding of which doesn't involve abrasion of telescopic elements, and with an expanded receptacle space that is strong enough to withstand the weight of the bag and contents thereof. It is an object of the present invention to provide such an expandable bag.

It is another object of the present invention to provide a method and apparatus for expanding bags, in which expanding the bag does not impede the bag's stability during travel.

It is yet another object of the present invention to provide a method and apparatus for expanding bags in which the obtained expanded receptacle is strong enough to withstand the weight of the bag and contents thereof.

Other objects and advantages of the invention will become apparent as the description proceeds.

SUMMARY OF THE INVENTION

The present invention relates to an expandable apparatus, comprising:

a. top and bottom base panels;

b. left and right collapsible walls, connected, respectively, to hinges at the left and right edges of the top and bottom panels; and c. supporting members configured to maintain said collapsible walls from unintentionally collapsing;

wherein the expandable apparatus may be brought from a collapsed configuration, in which the left and right collapsible walls are collapsed, to an expanded configuration in which the left and right collapsible walls are expanded.

According to an embodiment of the invention, the expansion of the apparatus does not change the horizontal location of said apparatus' center of gravity.

According to an embodiment of the invention, each collapsible wall comprises a top wall panel and a bottom wall panel interconnected by a hinge.

According to an embodiment of the invention, the supporting members are props, and wherein the top and bottom base panels comprise rigid anchoring elements suitable to hold the props when the expandable apparatus is in its expanded configuration.

According to an embodiment of the invention, the supporting members are props which are hinged into the top and bottom base plates, and wherein the top and bottom wall panels comprise rigid anchoring elements suitable to hold the props when the expandable apparatus is in its expanded configuration.

According to an embodiment of the invention, the props and the rigid anchoring elements enables a quick release of the props from corresponding anchoring elements, thus allowing a partial collapse of the side walls hence avoiding damage to the expandable apparatus.

According to an embodiment of the invention, each of the props is pivotal and self-locking.

An upper engagement element of each of the pivotal props is slidably mounted in a corresponding groove formed in a bottom face of the top panel that extends in a lengthwise direction to an impediment located at an intermediate region of the top panel and is continuously slidable along the groove in response to a degree of collapse of the left and right side walls. Each of the engagement elements, when the left and right collapsible side walls are set to the expanded configuration and corresponding pivotal props are self-locked, is in secured contact with a corresponding traversable obstacle that is provided along the corresponding groove, such that additional lengthwise displacement of each of the engagement elements towards the impediment is prevented due to its engagement with the obstacle. One of the engagement element and the obstacle is configured with resilient means which compress following transmission thereto of an actuating force, to facilitate displacement of the engagement element through a clearance between the obstacle and a wall of the groove that is smaller than a groove-engaging dimension of the engagement element when the corresponding pivotal prop is self-locked.

According to an embodiment of the invention, the supporting members are corner ledges, and wherein the side walls comprise tracks along which the corner ledges are brought to a supporting configuration.

According to an embodiment of the invention, the supporting members are border ledges, and wherein the side walls comprise tracks along which the border ledges are brought to a supporting configuration.

According to an embodiment of the invention, the supporting members comprise a rear side wall.

In another aspect, the present invention relates to an apparatus for expanding a bag, comprising:

a. a top and bottom frame configured to attach the apparatus to a bag;

b. left and right side walls, configured to be brought from a collapsed configuration to an upright configuration;
c. a rear wall, configured to be brought from a folded configuration to an upright configuration; and
d. a shelf attached via a hinge to the rear wall, configured to be brought from a folded configuration in which the shelf is doubled to the rear wall, to an horizontal unfolded configuration in which the shelf is caught by ledges in each of the side walls.

According to an embodiment of the invention, each of the left and right side walls comprises a side top wall that is interconnected via a hinge to a side bottom wall, wherein in the side walls' collapsed configuration the side top walls are doubled on the side bottom walls.

According to an embodiment of the invention, the rear wall comprises a rear top wall and a rear bottom wall, wherein the rear top wall is attached via a hinge to the top frame and is folded upwards in its folded configuration, and wherein the rear bottom wall is attached via a hinge to the bottom frame and is folded downwards in its folded configuration.

According to an embodiment of the invention, the panels and walls are made of Polypropylene.

According to an embodiment of the invention, the apparatus further comprises metal profiles at selected locations.

An expandable bag configured to be reversibly brought from a collapsed configuration to an expanded configuration, comprising:

a. a top side comprising a receptacle that is receptive both when the expandable bag is in its expanded configuration and in its collapsed configuration;
b. a bottom side comprising a compartment;
c. an expandable apparatus according to claim 1, wherein the top base panel is attached to the top side of the expandable bag, and said expandable apparatus is housed in said compartment when in its collapsed configuration;
d. a fastening apparatus configured to keep said expandable apparatus in its collapsed configuration; and
e. a covering, configured to cover all sides of said expandable apparatus and define an expanded receptacle;

According to an embodiment of the invention, the expansion of the bag does not change the horizontal location of said bag's center of gravity.

According to an embodiment of the invention, the top side receptacle is selected from a suitcase, a briefcase, a hand bag, or a backpack.

According to an embodiment of the invention, the expandable bag further comprises wheels and at least one handle.

According to an embodiment of the invention, the fastening apparatus comprises straps and a buckle.

According to an embodiment of the invention, the covering comprises a closable opening, allowing access to the expanded receptacle interior.

DETAILED DESCRIPTION OF THE INVENTION

Reference will now be made to an embodiment of the present invention, examples of which are illustrated in the accompanying figures for purposes of illustration only. One skilled in the art will readily recognize from the following description that alternative embodiments of the structures and methods illustrated herein may be employed, mutatis mutandis, without departing from the principles of the claimed invention.

The present invention relates to a bag capable of being expanded by mechanical manipulation of a plurality of collapsible rigid walls and temporary fixation thereof using a support element connected thereto.

In the context of this description, a bag can be any device suitable to store contents. It can be for example in the shape of a suitcase, briefcase, hand bag, or backpack. The bag can be provided with the following parts: any number of wheels, carrying handles, extendable handles, other commute components, and any other components common in ordinary bags, such as zippers.

Figure 1A:
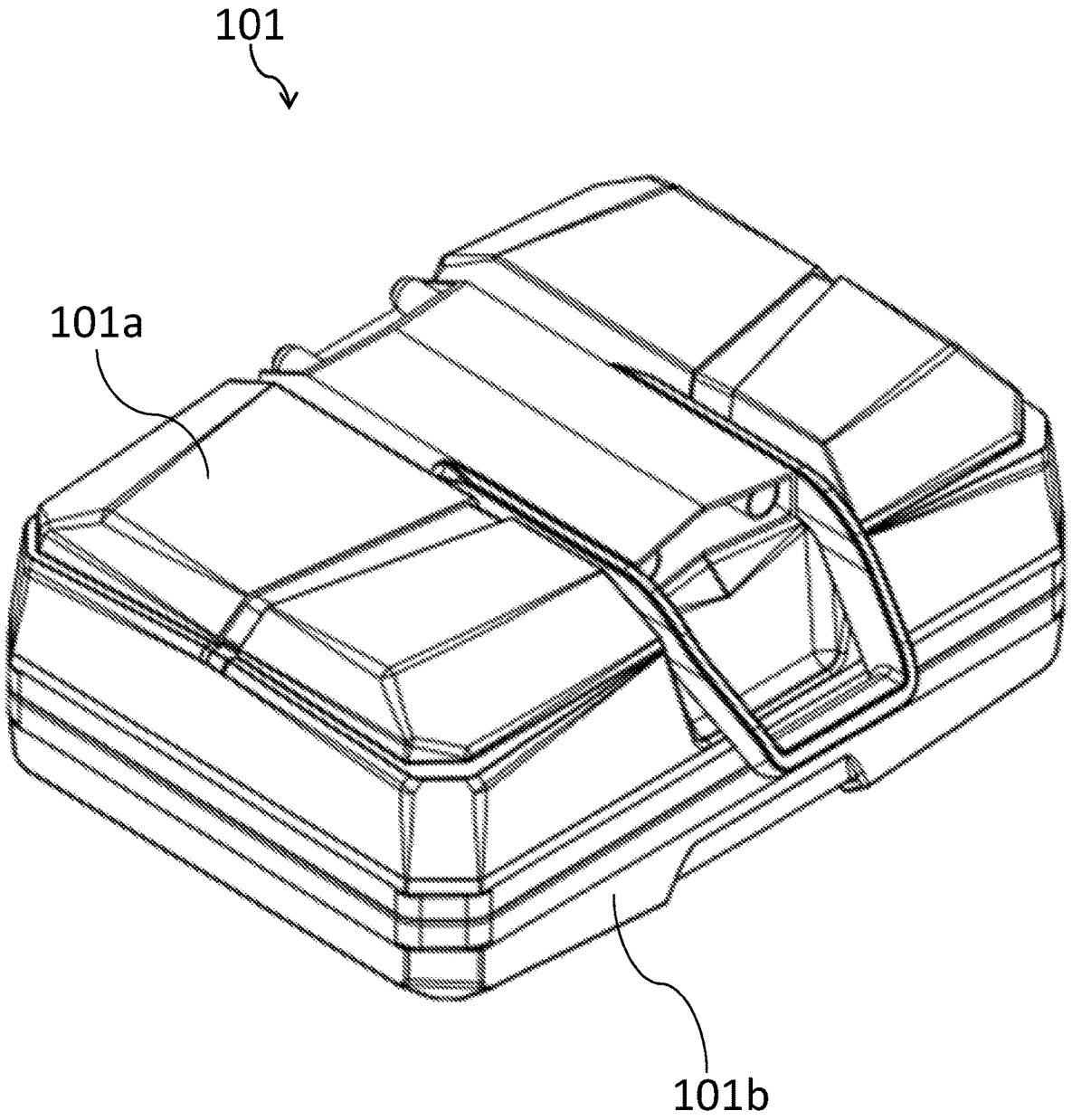
FIG. 1A is a perspective view of an expandable bag 101, according to an embodiment of the invention.
Figure 1B:
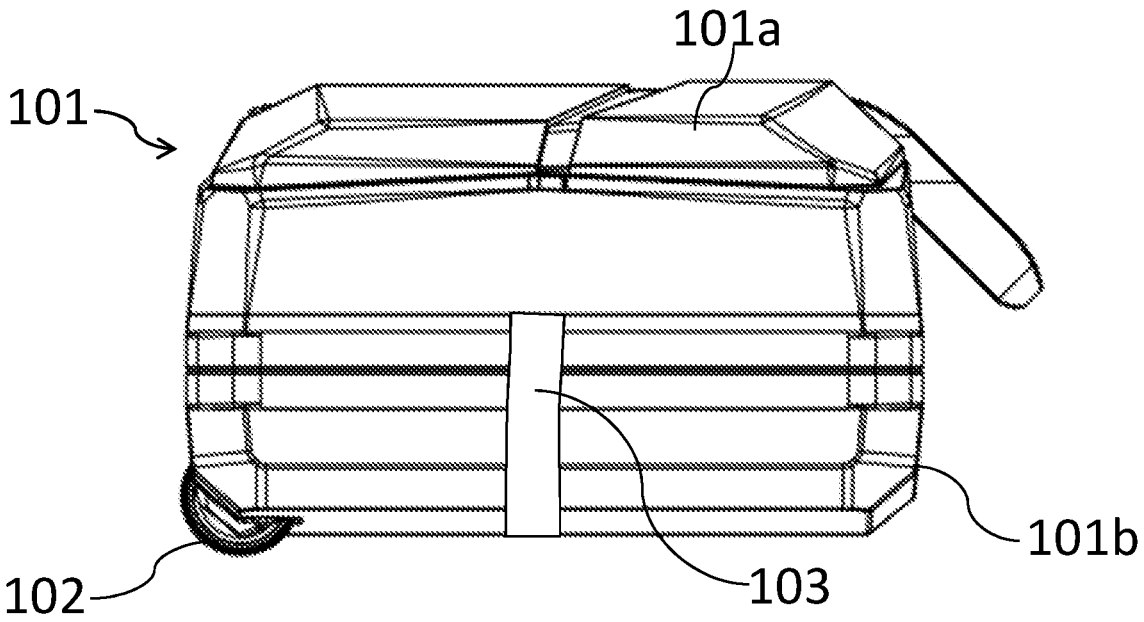
FIG. 1B is a side view the bag of FIG. 1A.

FIG. 1A is a perspective view of the bag 101, according to the first exemplary embodiment of the invention, shown in the shape of a briefcase. FIG. 1B shows the bag of FIG. 1A in a side view, showing wheels 102 at the bottom of the briefcase. A better view of wheels 102 is shown in FIG. 1C, which is a back view of the bag of FIG. 1A.

Figure 1C:
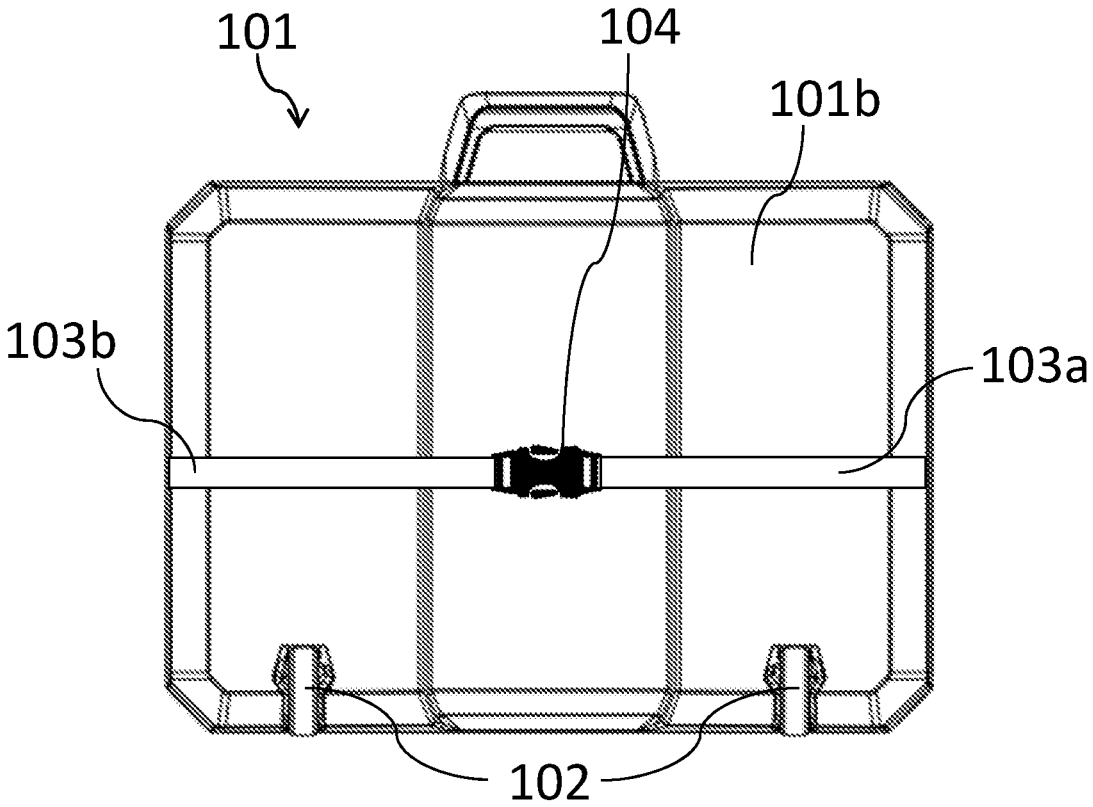
FIG. 1C is a back view of the bag of FIG. 1A.

Whilst the top side 101*a* of bag 101 comprises a briefcase, the bottom side 101*b* comprises a compartment in which the expandable apparatus (e.g. 201 in FIG. 2) of bag 101 is kept when in its collapsed configuration, as shown in FIGS. 1 (A-C). Top and bottom sides 101*a* and 101*b* are kept together in the collapsed configuration by a fastening apparatus 103 (shown in FIGS. 1B and 1C) comprising two straps 103*a* and 103*b* which extend from opposite edges of top side 101*a* to under bottom side 101*b* where they meet and are reversibly connected by a buckle 104.

It is noted that the present invention is not limited to the fastening apparatus 103, and buckle 104 may be replaced by any other apparatus suitable to fasten straps 103*a* and 103*b*, e.g. clips, buttons, a Velcro strap, snaps, etc. Furthermore, fastening apparatus 103 may be replaced by any other apparatus suitable to fasten top and bottom parts 101*a* and 101*b* together, e.g. a zipper.

Figure 2A:
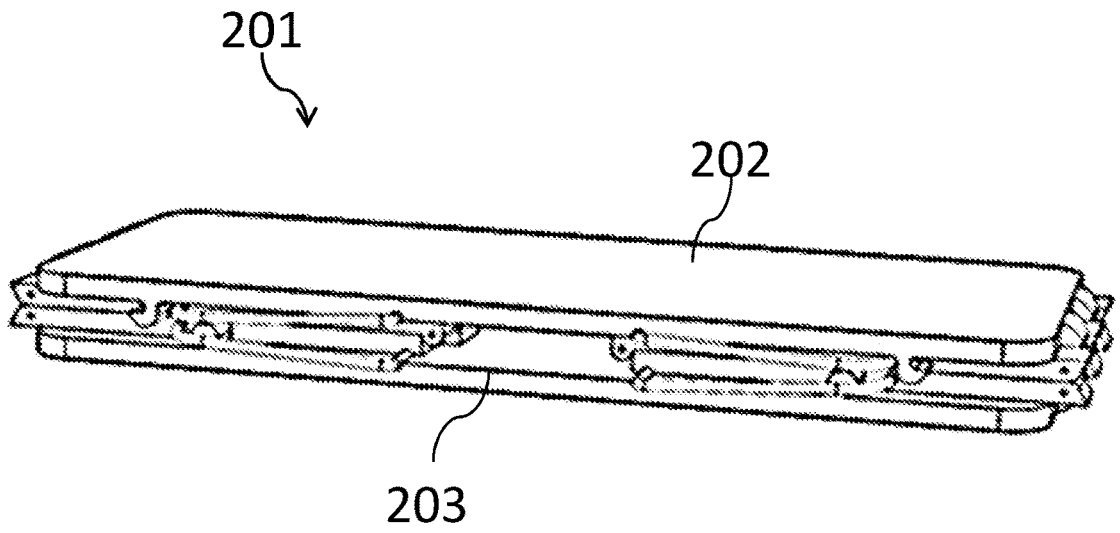
FIG. 2A is a perspective view of an expandable apparatus in a collapsed configuration, according to an embodiment of the present invention.
Figure 2B:
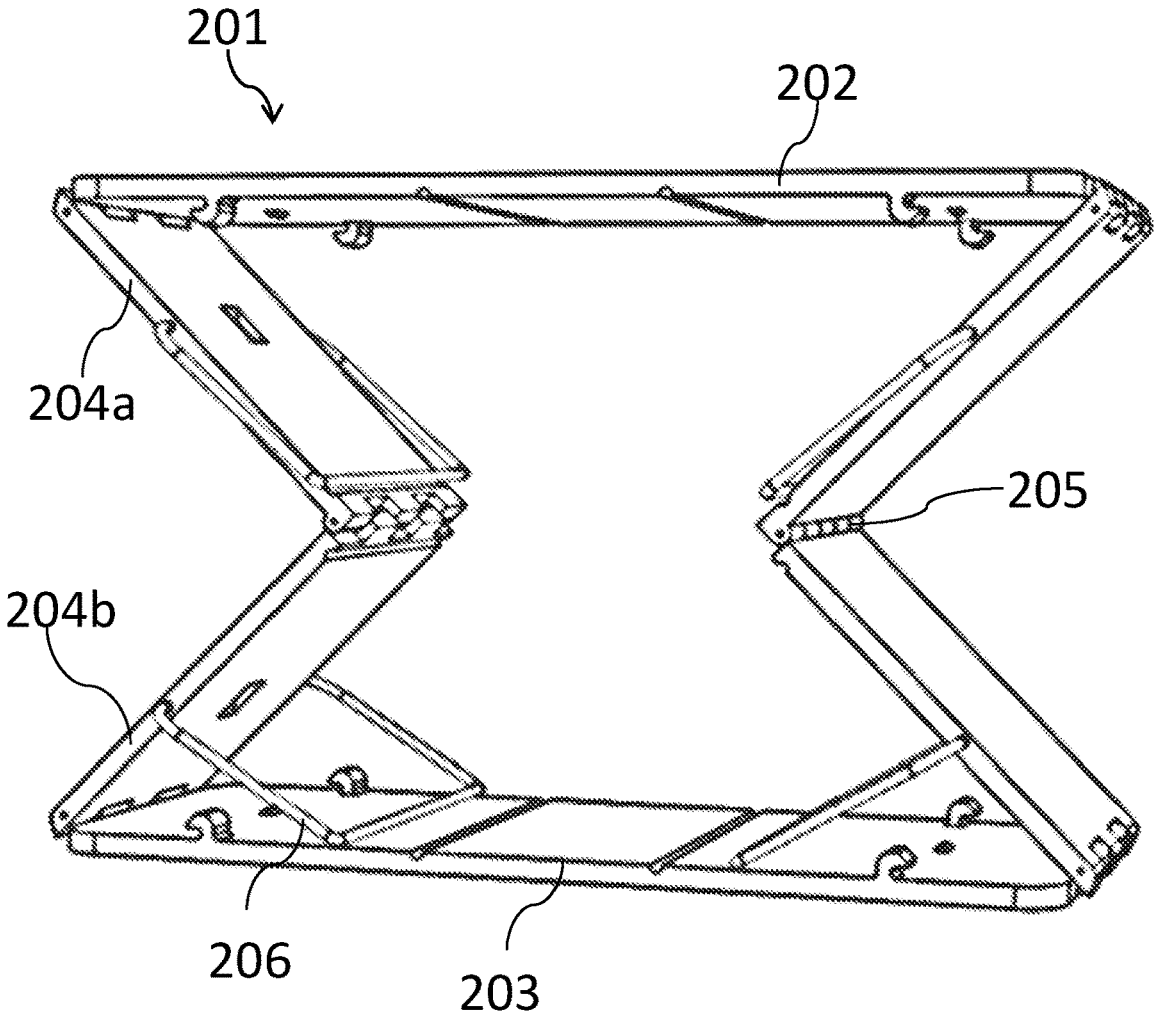
FIG. 2B shows the expandable apparatus of FIG. 2A in a configuration between the expanded and the collapsed configurations.
Figure 2C:
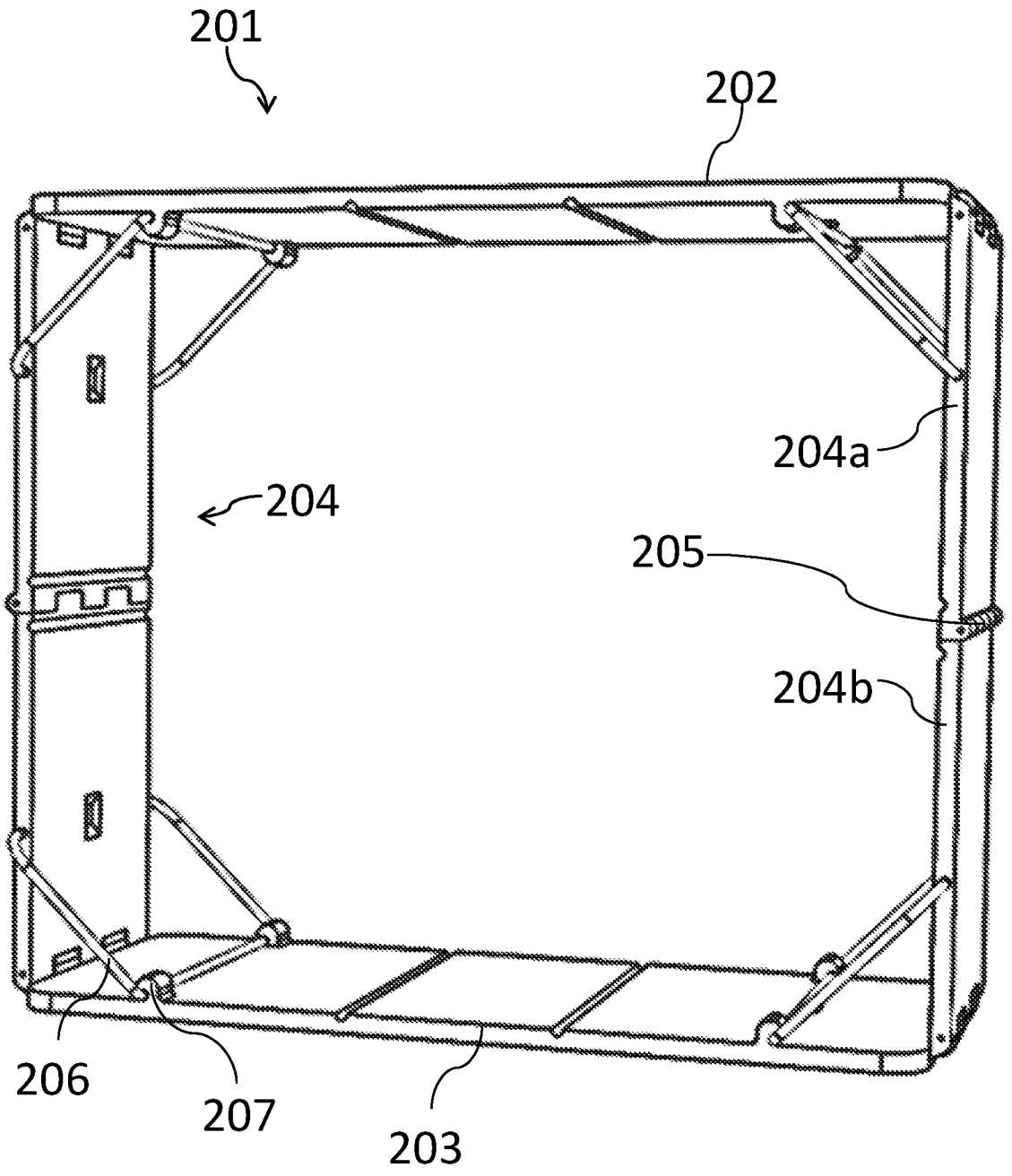
FIG. 2C shows the expandable apparatus of FIG. 2A in its expanded configuration.

When fastening apparatus 103 is unfastened, top and bottom sides 101*a* and 101*b* become separable. According to an embodiment of the present invention top and bottom sides 101*a* and 101*b* may be separated manually by forcing them apart or by raising top side 101*a*. FIG. 2A shows a perspective view of an expandable apparatus 201 in a collapsed configuration according to an embodiment of the present invention. Separation of top and bottom sides causes expandable apparatus 201 to expand and obtain its expanded configuration. FIG. 2B shows expandable apparatus 201 in a configuration between the expanded and the collapsed configurations, and FIG. 2C shows expandable apparatus 201 in its fully expanded configuration (Further illustration of the expansion process is described in FIGS. 6A-6D).

Expandable apparatus 201 comprises a top base panel 202 suitable to support top side 101*a* of bag 101, a bottom base panel 203 suitable to support bottom side 101*b* of bag 101, side walls 204 comprising top wall panels 204*a* (connected by a hinge to top base panel 202) and bottom wall panels 204*b* (connected by a hinge to bottom base panel) that are interconnected by a hinge 205.

Supporting members 206 are provided so as to support side walls 204, prevent them from collapsing, and to rigidly and reversibly maintain expandable apparatus 201 in its expanded configuration. In the embodiment of FIGS. 2A-2C, supporting members 206 are in the form of props that are pivotally connected to each of the top and bottom wall panels, 204*a* and 204*b*. In the engaged configuration of FIG. 2C props 206 extend to rigid anchoring elements 207 in the top and bottom base panels and are held therein, thereby providing support to the side walls 204 and preventing them from unintentionally collapsing. In other configurations of apparatus 201 (as shown in FIGS. 2A and 2B) props 206 allow side walls 204 to be collapsed. Props 206 are manually brought to anchors 207 and may be manually released therefrom for collapsing the expandable apparatus 201. When the front and rear sides of expandable apparatus 201 are covered, a receptacle is received between the coverings, panels 202 and 203 and side walls 204.

Figure 2D:
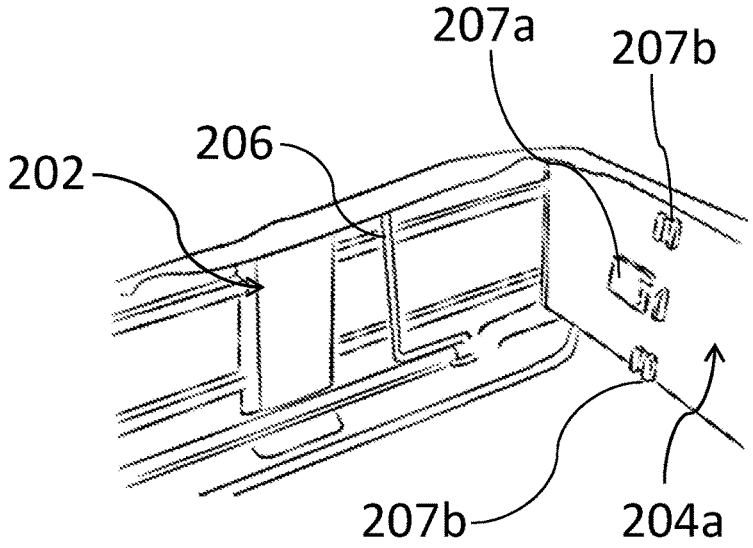
FIGS. 2D-2F illustrates a different anchoring arrangement, according to an embodiment of the present invention.
Figure 2E:
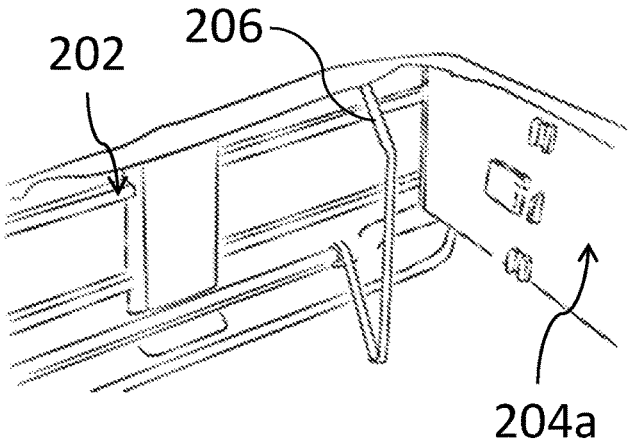
Figure 2F:
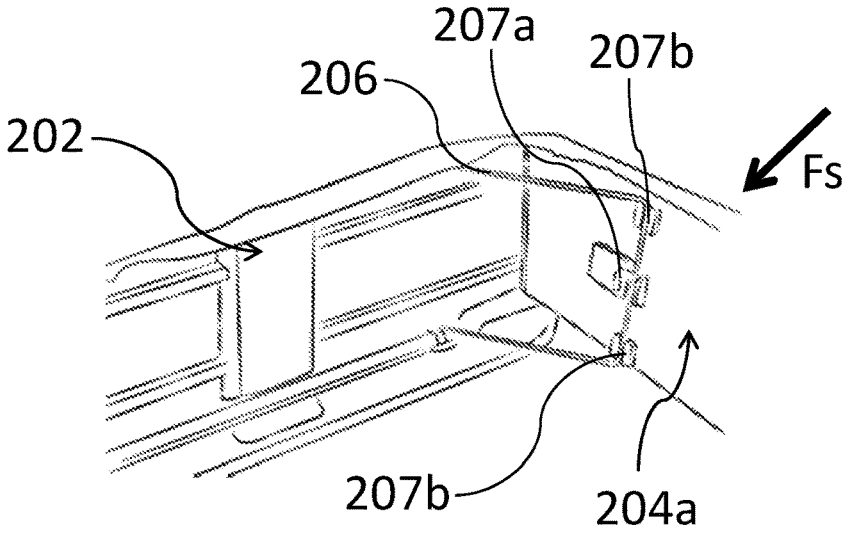

FIGS. 2D-2F illustrates a different anchoring arrangement, according to an embodiment of the present invention, in which props 206 are pivotally connected to the top and bottom base panels 202 and 203 and the anchoring elements 207 are provided in the top and bottom side walls 204*a* and 204*b*, wherein in the folded position (FIG. 2D) props 206 are stored within the base panels (for example base 202) and during the expansion process, props 206 are released (FIG. 2E) and engaged into anchoring elements 207 (i.e., of wall 204*a*). FIG. 2F further illustrates the anchoring arrangement which is comprised of center anchoring elements 207*a* and two side elements 207*b*. This anchoring arrangement provides the required support to the weight of the top side 101*a* of bag 101, and enables the manual release of props 206 from anchoring elements 207. Furthermore, this different arrangement enables a quick release of props 206 from anchoring elements 207 in the case of a significant side load or impact as indicated by vector Fs in FIG. 2F (e.g., during the stacking or loading of the invented bag into the cargo compartment of an aircraft), resulting with a partial collapsing of sidewalls 204 hence may prevent damage such as abrasion, deformation or breakage to expandable apparatus 201.

Obviously different props sizes, hinge distances and anchoring locations would be suitable to provide the appropriate support size and anchoring angles for different embodiments of the present invention. A skilled person in the art would easily select the specific supports design in accordance with the specific embodiment (e.g., size, shape and weight of the specific embodiment of the invented bag).

Figure 3A:
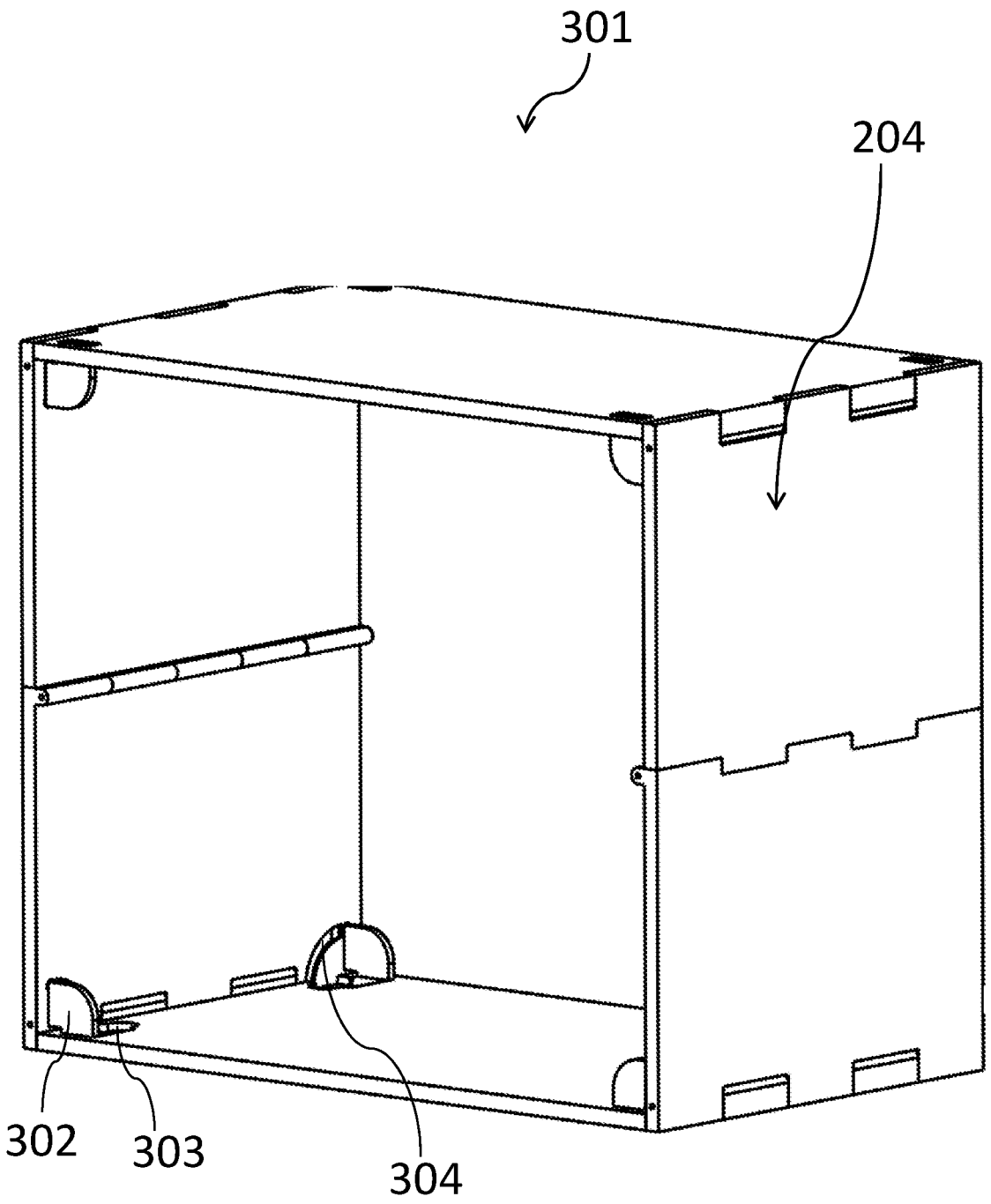
FIG. 3A is a perspective view of an expandable apparatus according to another embodiment of the present invention.

FIG. 3A schematically illustrates an expandable apparatus 301 in its expanded configuration suitable to be housed in bottom side 101*b* of bag 101 when collapsed, according to another embodiment of the present invention. Expandable apparatus 301 comprises supporting members in the form of corner ledges 302 configured to support side walls 204, prevent them from collapsing, and to maintain expandable apparatus 301 in its expanded configuration. In their unengaged configuration, corner ledges 302 are collapsed and concealed inside grooves 303 in the top and bottom base panels. Each corner ledge comprises a protrusion on the side abutting the side wall, and is respectively connected via a hinge to the top or bottom base panel (as schematically illustrated in FIG. 3A). A corner ledge 302 is brought to an upright position by sliding the protrusion through a track 304 in side walls 204, and finally obtains an engaged configuration in which the corner ledge is kept upright by the protrusion entering a groove in track 304.

Figure 3B:
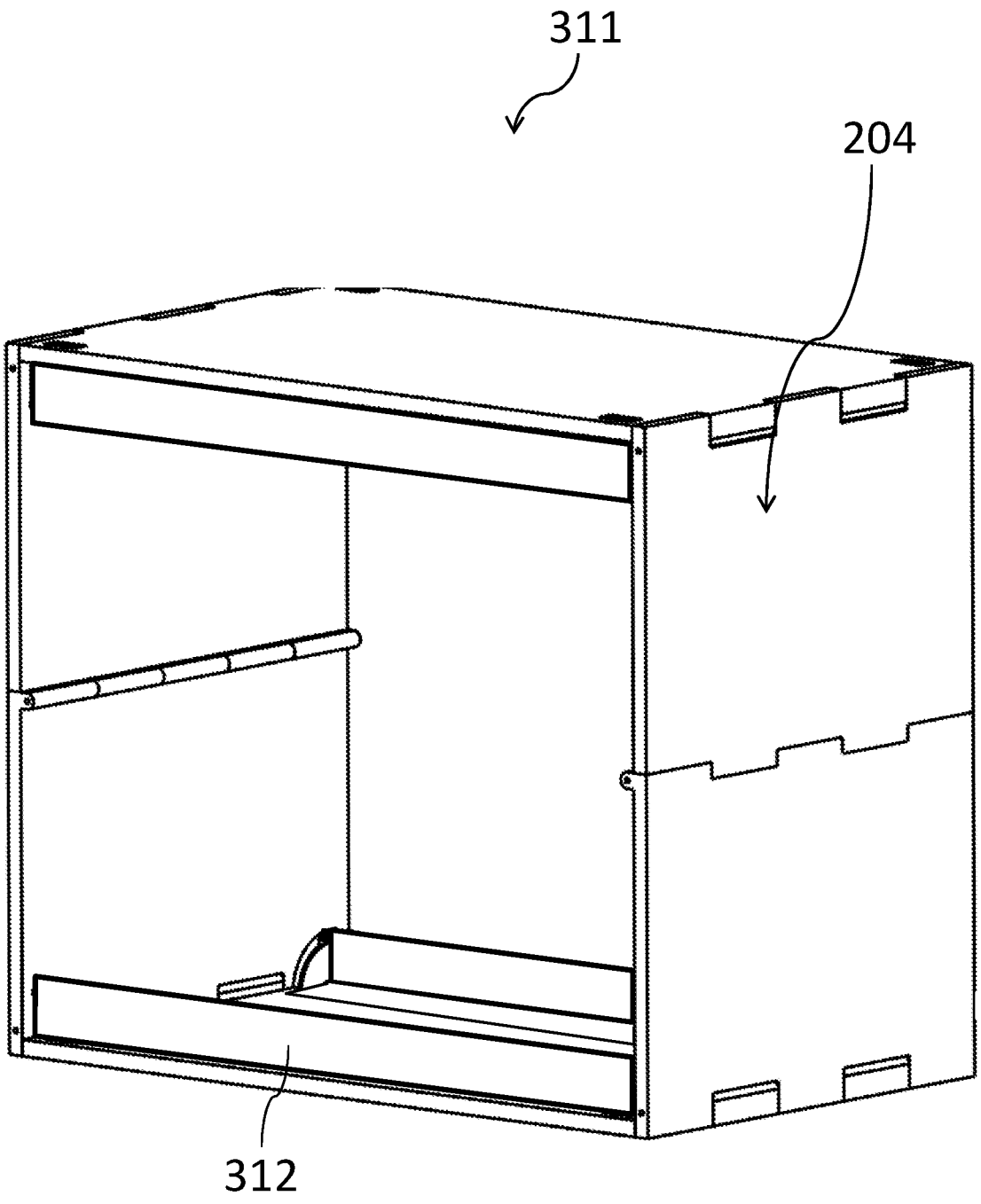
FIG. 3B is a perspective view of an expandable apparatus, according to yet another embodiment of the present invention.

FIG. 3B schematically illustrates an expandable apparatus 311 in its expanded configuration suitable to be housed in bottom side 101*b* of bag 101 when collapsed, according to yet another embodiment of the present invention. Expandable apparatus 311 comprises supporting members in the form of border ledges 312 which distinct from corner ledges 302 of FIG. 3A in that each border ledge provides support to both side walls 204, whereas each corner ledge 302 provides support only to one of the side walls.

Figure 4:
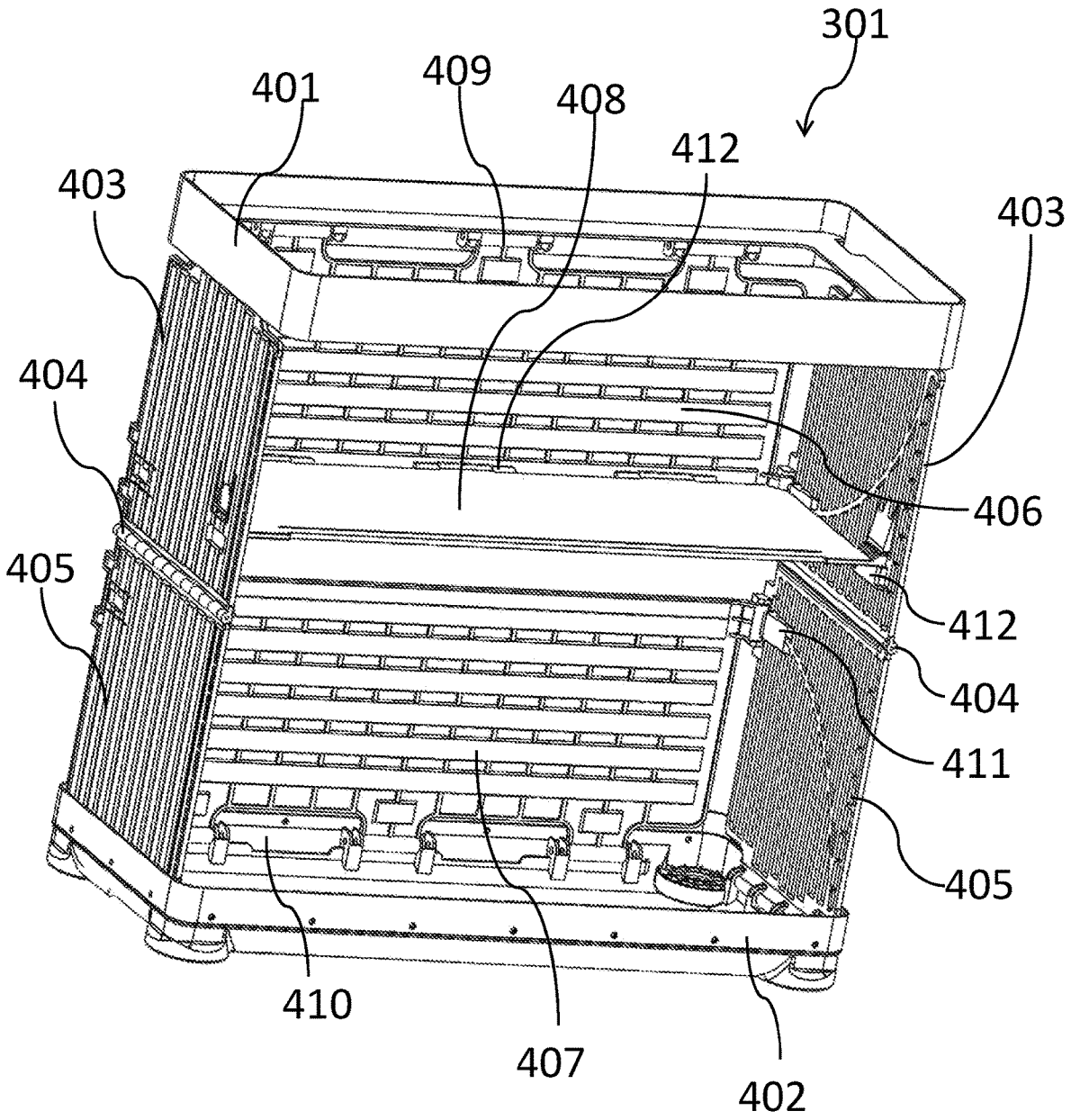
FIG. 4 is a perspective view of an expandable apparatus according to still another embodiment of the present invention.

FIG. 4 is a perspective view from the front of an expandable apparatus 401 in an expanded configuration, according to still another embodiment of the present invention, in which support is provided to the side walls, inter alia, from rear side supporting members. Top frame 401 and bottom frame 402 are connected to the top and bottom sides of bag 101, respectively. The right and left sides each comprise a side top wall 403, connected by a hinge 404 to a side bottom wall 405. The rear side comprises a rear top wall 406, attached via a hinge 409 to top frame 401, and a rear bottom wall 407 attached via a hinge 410 to bottom frame 402. A shelf 408 is connected to a hinge 412 at the bottom of rear top wall 406 and is suspended between the right and left side top walls.

According to an embodiment of the present invention, the walls (i.e. 403, 405, 406, 407) and shelf 408 of the expandable apparatus are made of rigid material that is also light weight. An example of such material is Polypropylene; however other plastic material may be sufficient. The faces of side walls 403 and 405 are rippled, thereby enforcing their vertical resistance when in the expanded configuration of FIG. 4.

According to another embodiment of the invention, metal (e.g. aluminum) profiles are provided at several locations in order to further strengthen the expanded apparatus 301. According to an embodiment of the invention, metal profiles are provided at the front side of shelf 408, at hinge 412, and at the front sides of side bottom walls 405.

After expandable apparatus 401 is fully expanded rear bottom wall 407 may be brought to its unfolded position in which its top side is held by ledges 411 in the rear side of each side bottom wall 405, thereby preventing the side walls from collapsing inward. Furthermore, in order to further prevent collapsing of the side walls and to provide enhanced strength to the walls of expandable apparatus 401, shelf 408 may be brought to its unfolded position in which it is caught on ledges 411 in each of side top walls 403.

In order to collapse expanding apparatus 301, rear bottom wall 407 and shelf 408 must each be brought to their respective folded configurations, and rear top wall 406 must also be folded upwards to its doubled configuration. This allows side walls 403 and 405 to collapse inward to their doubled configuration.

The accepted volume between the top and bottom panels/frames and the side walls defines a receptacle into which goods may be inserted. An expandable apparatus may be covered by a flexible element (e.g. fabric) that may be attached to the exterior thereof. An openable cover may be kept inside the expandable apparatus when collapsed, and may be retrieved therefrom during or after expansion.

Figure 5:
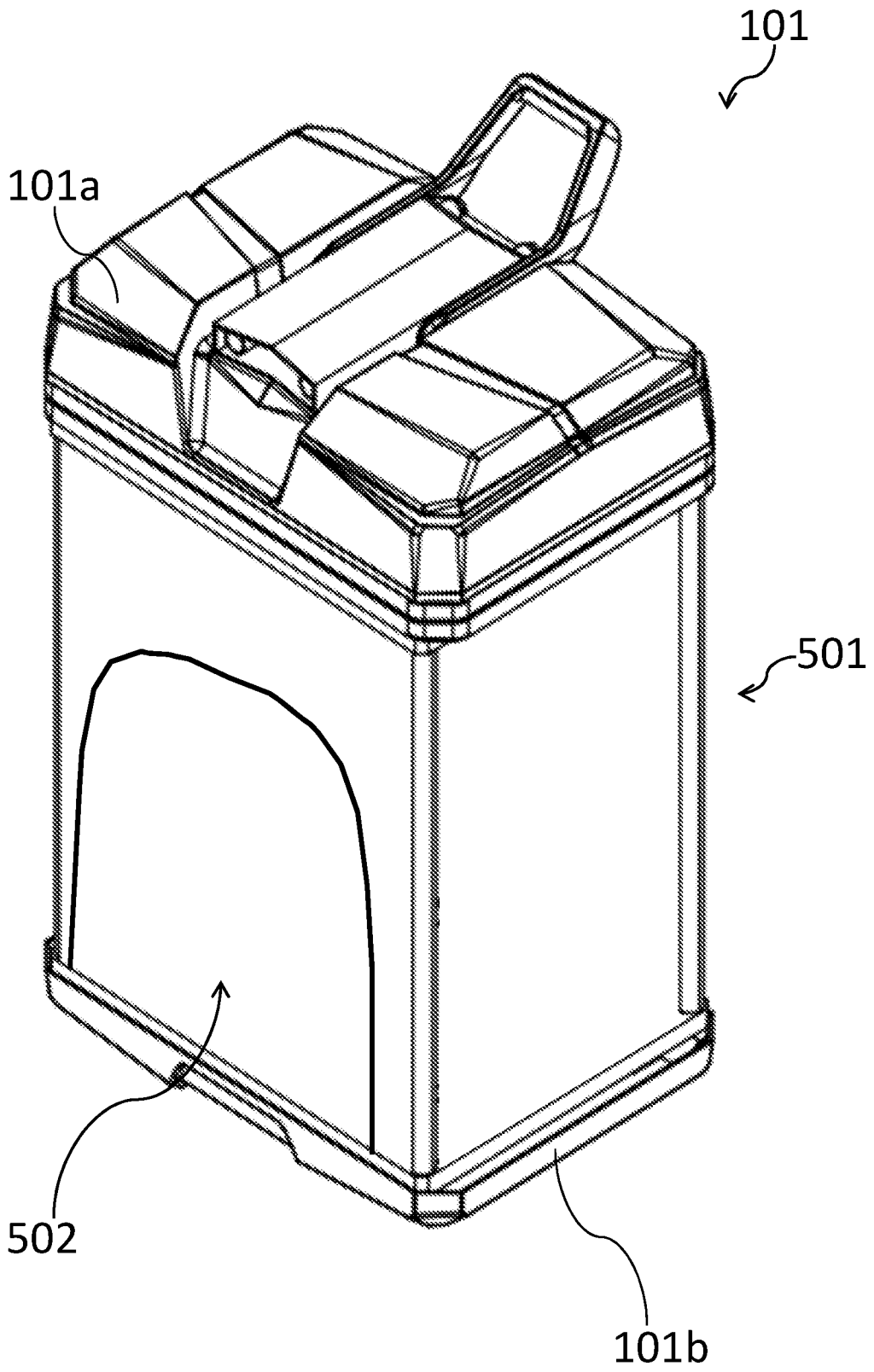
FIG. 5 is a perspective view of the bag of FIG. 1A in its expanded configuration, according to an embodiment of the invention.

FIG. 5 is a perspective view of the bag 101 of FIG. 1A in its expanded configuration, showing a fabric covering and fully defining an expanded receptacle 501 between the top side 101*a* and bottom side 101*b* of bag 101. Closable opening 502 (shown in FIG. 5 on the front side of bag 101) allows access to the inner volume of receptacle 501, for instance in order to insert and retrieve contents therefrom, or to collapse the expanding apparatus. The volume between the top and bottom sides 101*a* and 101*b* is supported and maintained by an expandable apparatus, such as demonstrated in one of the abovementioned embodiments (see FIGS. 2C, 3A, 3B or 4).

Figure 6A:
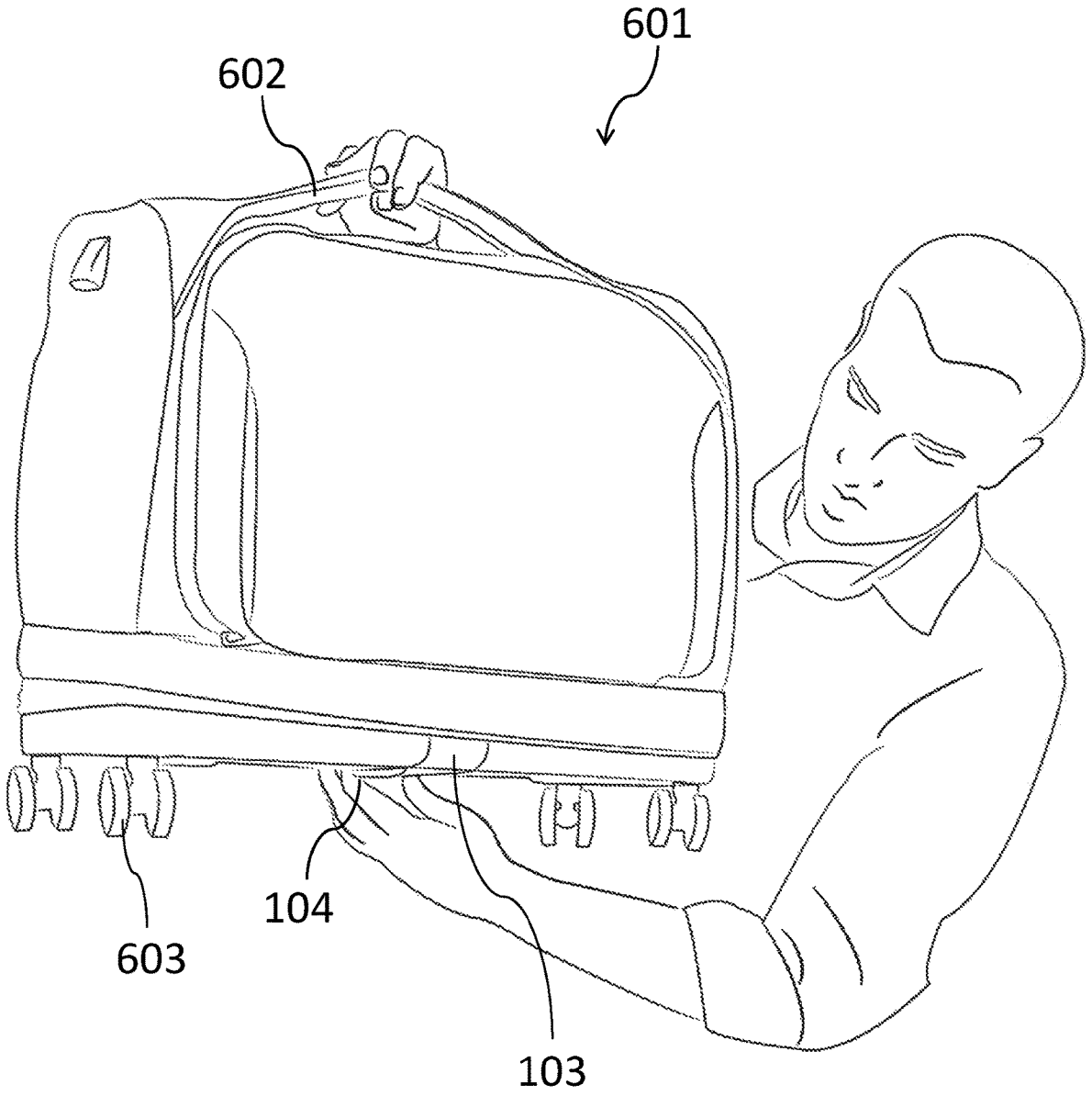
FIGS. 6A-6D illustrates the expansion process of the invented bag, according to yet another embodiment of the present invention.
Figure 6B:
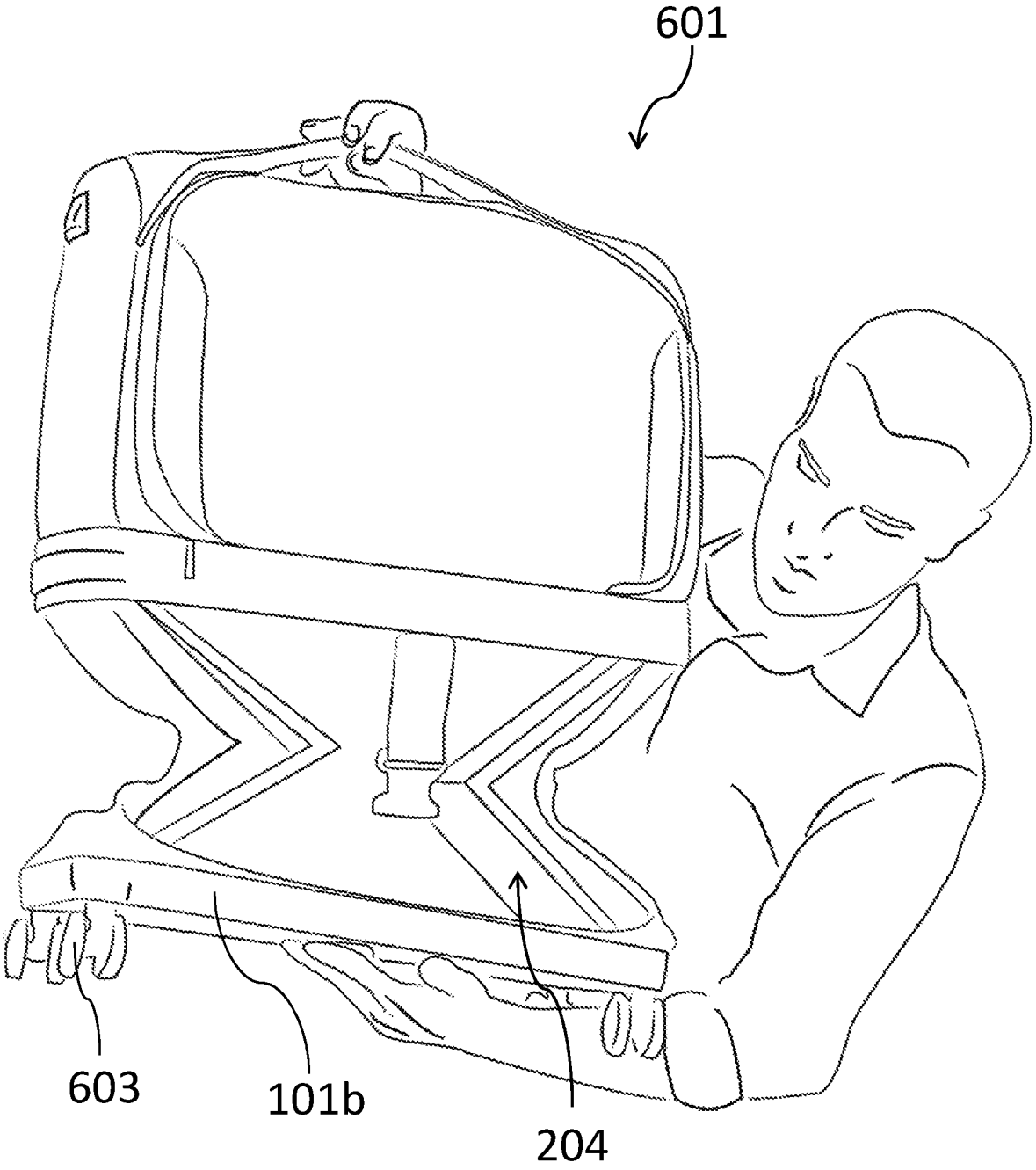
Figure 6C:
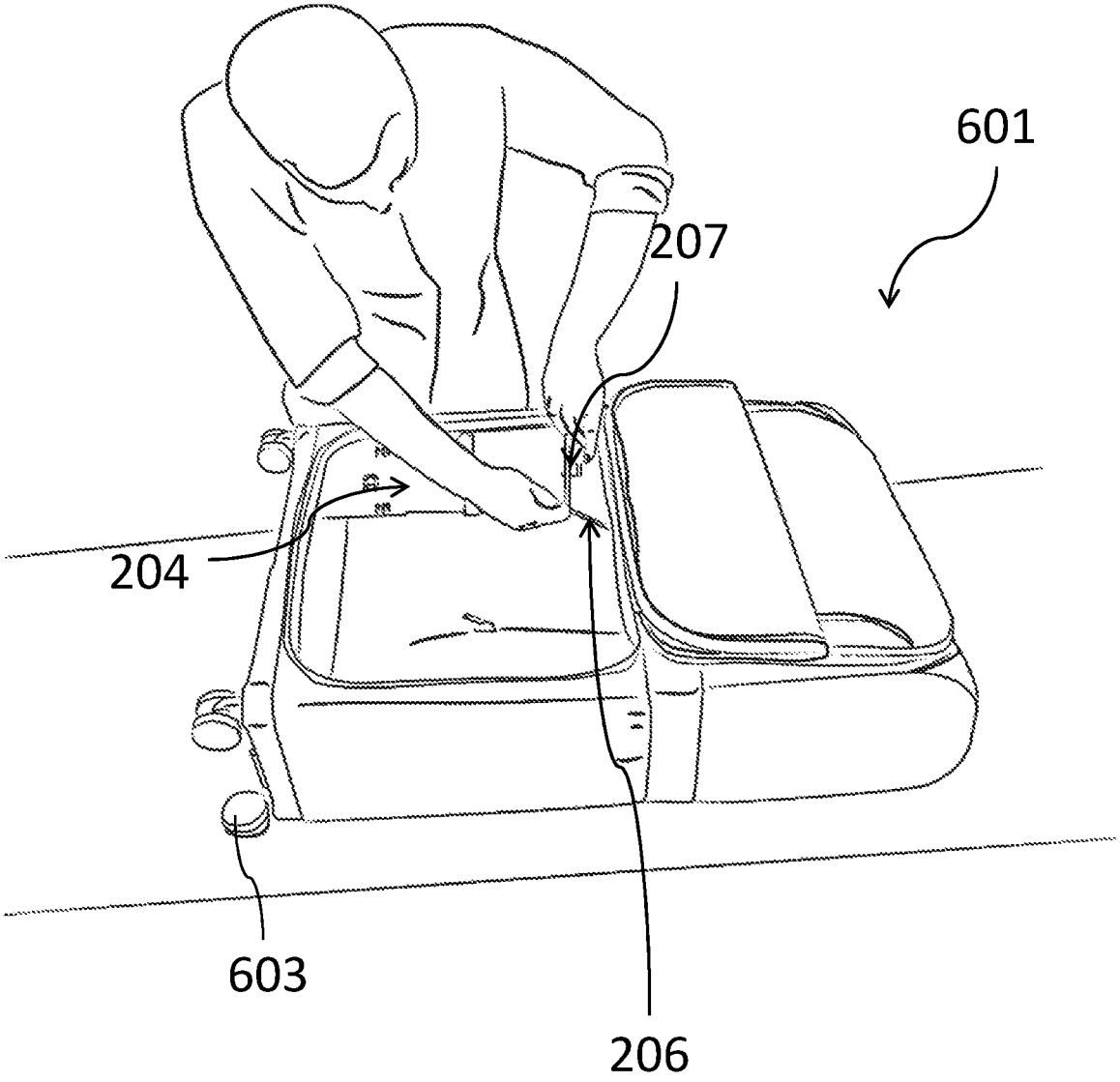
Figure 6D:
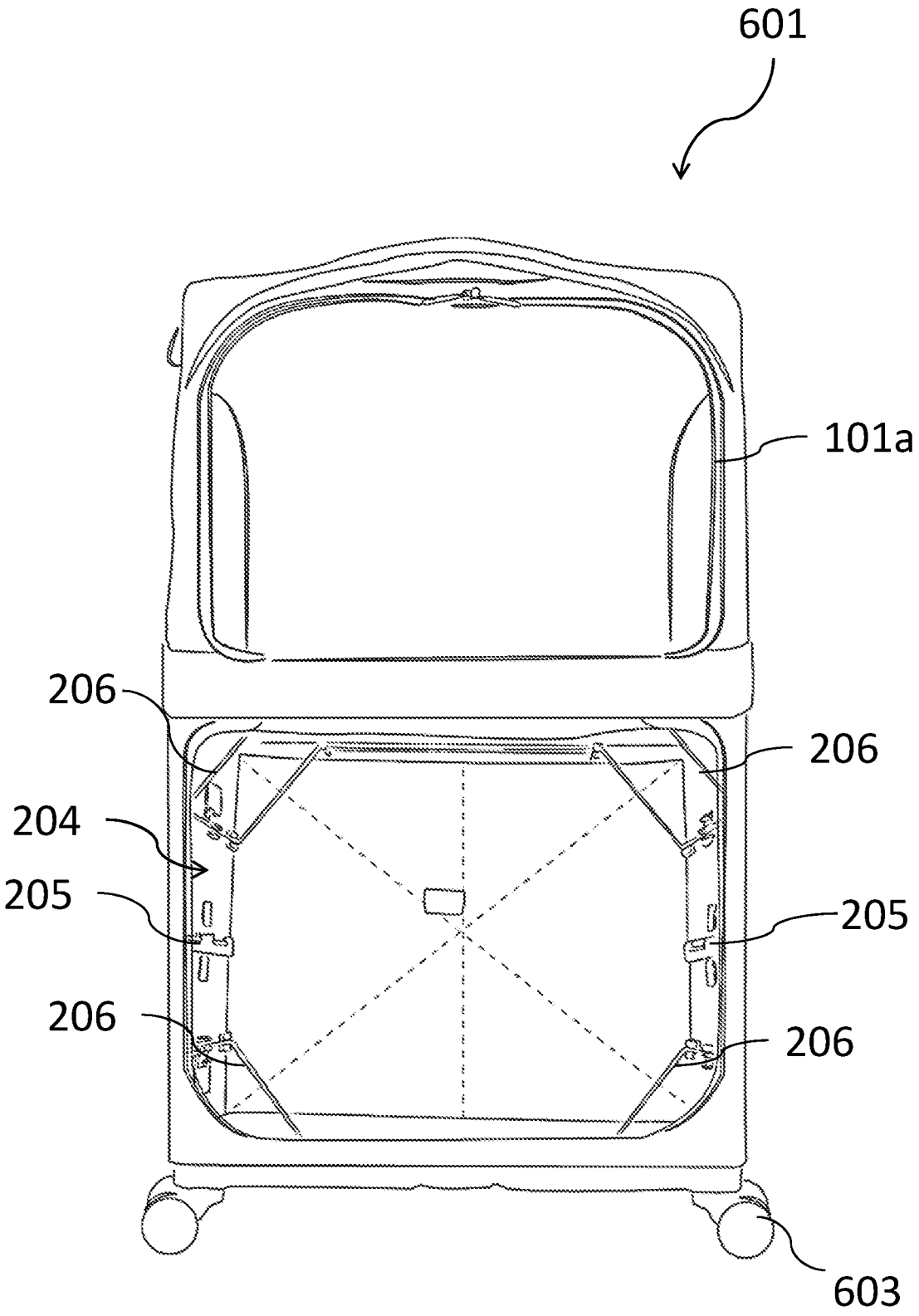

FIGS. 6A-6D further illustrates the expansion process of a bag 601, according to an embodiment of the present invention. At first, bag 601 is lifted from handle 602 and buckle 104 (as best shown in FIG. 1C) is unlocked to release fastening apparatus 103 (see FIG. 6A), thus allowing the weight of bottom side 101*b* and attached elements (e.g., bottom base panel 203 (shown in FIG. 2) and wheels 603) to pull down and unfold side walls 204 (see FIG. 6B). As soon as walls 204 are fully unfolded, bag 601 is placed on its back to allow convenient engagement of props 206 into anchoring elements 207, thus forming the rigid expansion support (see FIG. 6C). FIG. 6D further illustrated the expanded apparatus in its final unfolded and supported position with its rear side covered, forming the desired receptacle ready to store the desirable articles.

FIGS. 6A-6D further demonstrates the simple and rapid process which turns a relatively small travelling bag into a suitcase, providing an extremely efficient receptacle for a passenger who flies with minimal luggage using the unexpanded bag in one direction, hence taking the bag into the passenger cabin and flies back with further articles utilizing the same bag in its expanded configuration which is loaded as a suitcase into the airplane's cargo compartment. For example travelling to a vacation and returning with gifts, or vice versa—flying to a commercial fair/show with commercial papers and samples and returning with personal articles. In other words, the apparatus of the present invention provides a first type of product in its collapsed configuration or unexpanded state (e.g., a passenger's cabin luggage or trolley), and a second type of product in its expanded configuration or expanded state (e.g., a suitcase that is at least twice the dimensions of the product in its unexpanded state).

It is noted that the top side of bag 101 or bag 601 is not limited to any conventional sized receptacle, and may be smaller in size, equal or larger than the size of the expandable apparatus in its expanded configuration. Accordingly, wheels 102 or 603 may be substituted with commercially available detachable wheels that may be inserted into openings in the bottom side 101*b*.

It can be easily noticed in the described embodiments and figures (best shown in FIGS. 1B, 5, 6A and 6B) of the present invention, that the expansion of the expendable receptacle is executed in a "stretching" manner that does not impede the receptacle's stability by keeping the receptacle center of gravity at the same or similar horizontal location, i.e., when the receptacle is erected and ready to be rolled on its wheels, it keeps standing with no need for an external/user support. For example, in a bag that can change its form from a "cabin" trolley into a "cargo" suitcase, the expansion result in a greater distance between the top portion of the bag (where usually the bag's handle is located) and the base or bottom portion of the bag (where usually the bag's wheels are located).

FIGS. 7 and 8 illustrate another embodiment of a collapsible bag 701 which comprises a fixed lower wheelable compartment 720, and an upper collapsible and expandable compartment 730 located above fixed compartment 720. The pivoting supporting members 739 are self-locking.

Figure 7C:
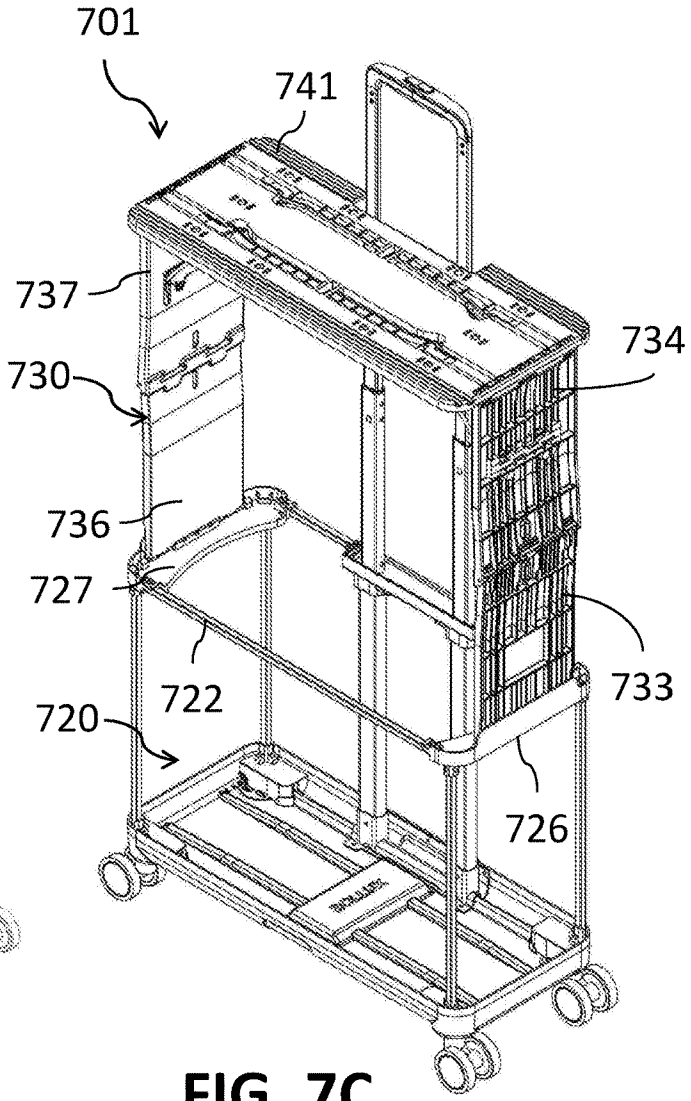
FIG. 7C is a perspective view from above of the bag of FIG. 7A while the upper compartment is shown in a fully expanded configuration.
Figure 7B:
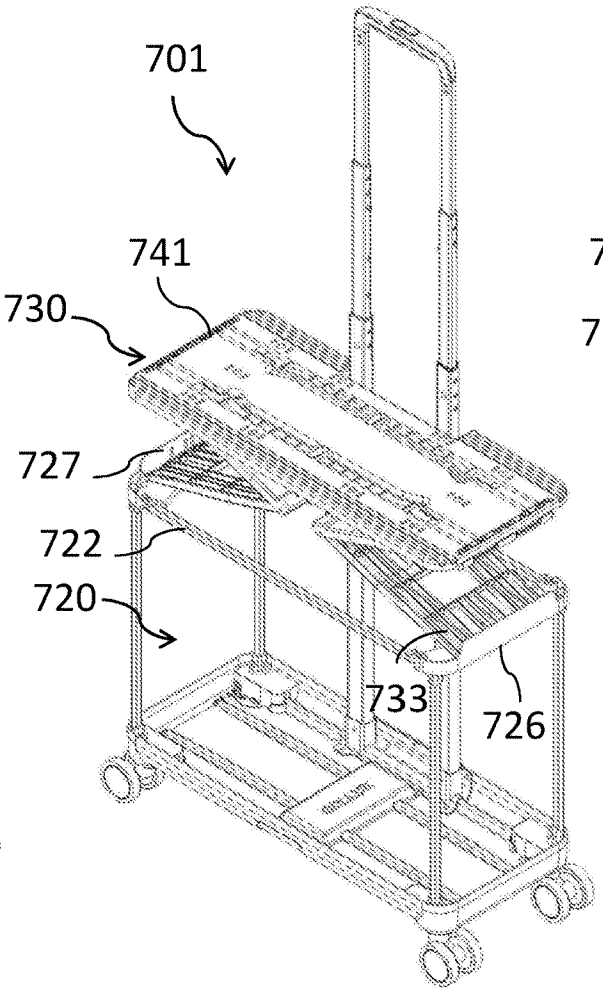
FIG. 7B is a perspective view from above of the bag of FIG. 7A while the upper compartment is shown in a partially expanded configuration.
Figure 7A:
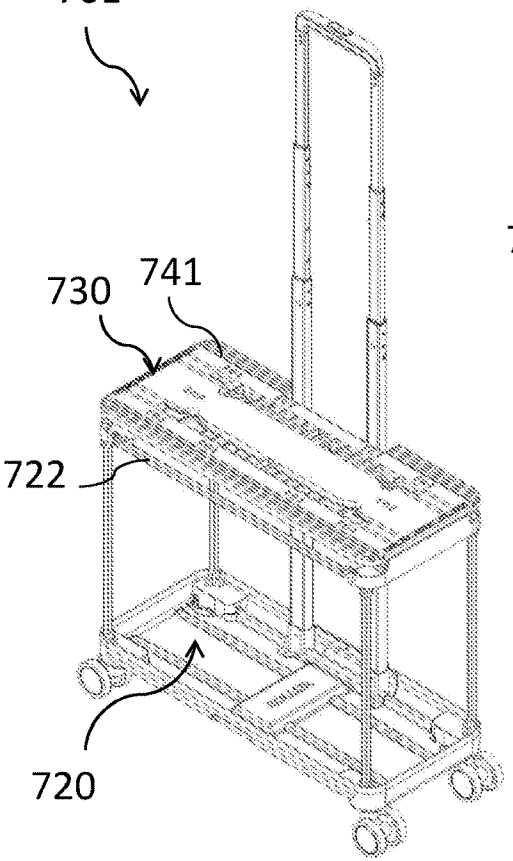
FIG. 7A is a perspective view from above of a collapsible bag according to yet another embodiment shown without fabric covering and comprising a fixed lower wheelable compartment, and an upper collapsible and expandable compartment located above the fixed lower wheelable compartment shown in a fully collapsed configuration.

Compartment 730 is shown in a fully collapsed configuration in FIG. 7A such that its top wall panel 741 is supported by upper horizontal frame elements 722 of lower compartment 720, or by a surface attached thereto, while the folded side walls are positioned between top wall panel 741 and frame elements 722.

In FIG. 7B, compartment 730 is shown to be partially expanded while lower right wall 733 and lower left wall 736 are pivotally connected to opposed vertical frame elements 726 and 727, respectively, located between two horizontal frame elements 722 and top wall panel 741 remains in a substantially horizontal orientation. Upper right wall 734 and upper left wall 737 are hingedly connected to lower right wall 733 and lower left wall 736, respectively, so that when compartment 730 is set to a fully expanded configuration as shown in FIG. 7C, right walls 733-734 and left walls 736-737 assume a substantially vertical orientation. A tab 743 protruding downwardly from an upper wall is received in a recess 748 formed in an upper region of a corresponding lower wall when upper compartment 730 is being set to an expanded configuration, as shown in FIG. 8B.

FIGS. 8A-F illustrate the self-locking capability of bag 701. A bottom interconnecting portion of each of two spaced pivoting supporting members 739 is pivotally connected to an intermediate region of upper right wall 734 at the inner face thereof, and the bottom portion of another two spaced pivoting supporting members 739 is pivotally connected to an intermediate region of upper left wall 737 at the inner face thereof. An upper engagement element 753 of each of the pivoting supporting members 739 is slidably mounted, for example irremovably mounted, in a corresponding groove 763 formed in the bottom face of top wall panel 741 that extends in a lengthwise direction from one of the side walls to an impediment 769 located at approximately a lengthwise midline of top wall panel 741. Engagement element 753 is slidable along groove 763 in response to the degree of collapse of the upper compartment.

Each pair of pivoting supporting members 739 is shown to be U-shaped with two arms and an elongated bottom element interconnecting the two arms to provide superior wall stability; however, the walls will be suitably supported as well when each supporting member 739 is configured as a single arm that is unconnected to another supporting member.

Figure 8A:
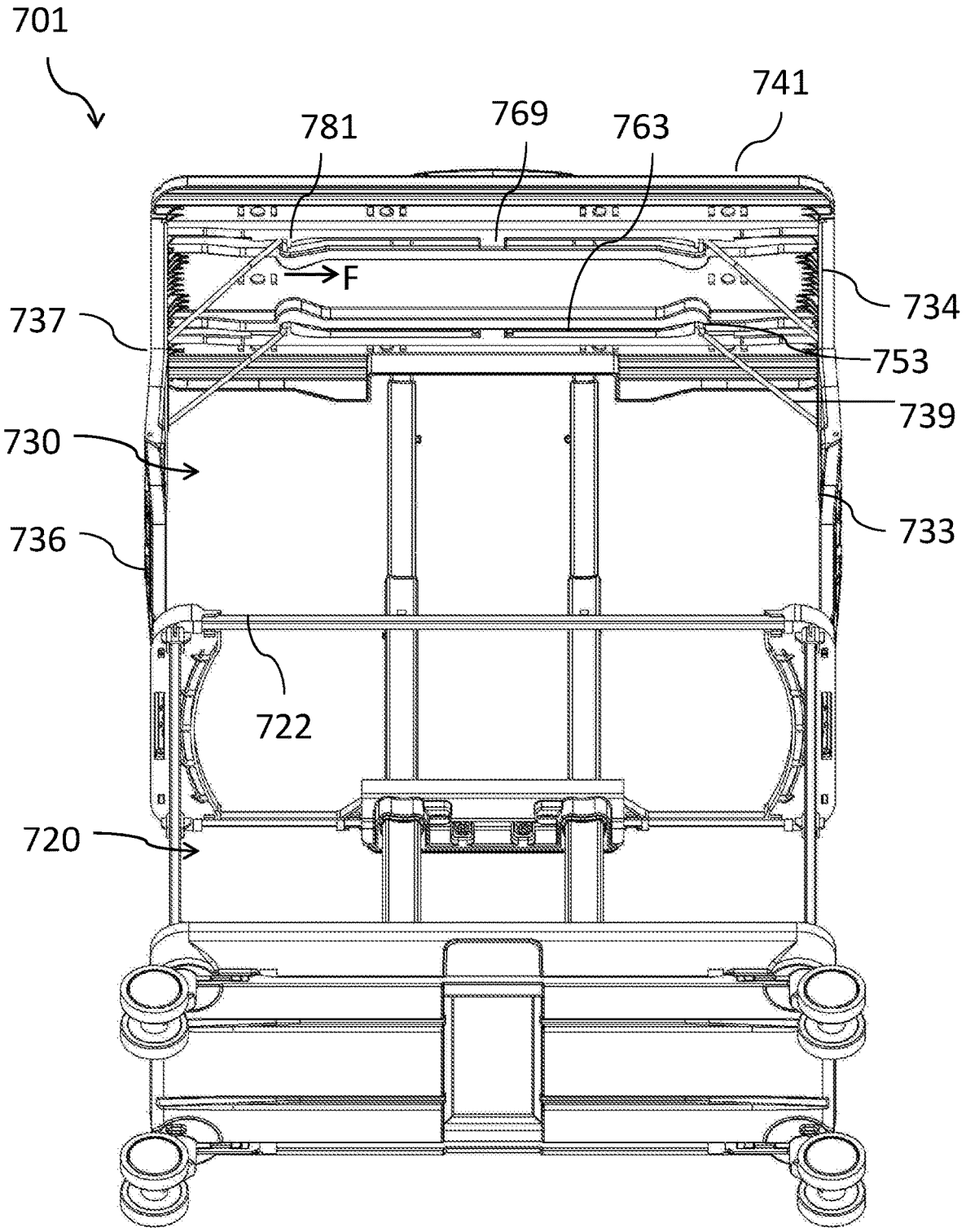
FIG. 8A is a perspective view from below and from the front of the bag of 7A while shown in a fully expanded configuration and without fabric coverings, showing each slidable engagement element of a pivoting supporting member when in secured contact with a traversable obstacle.
Figure 8B:
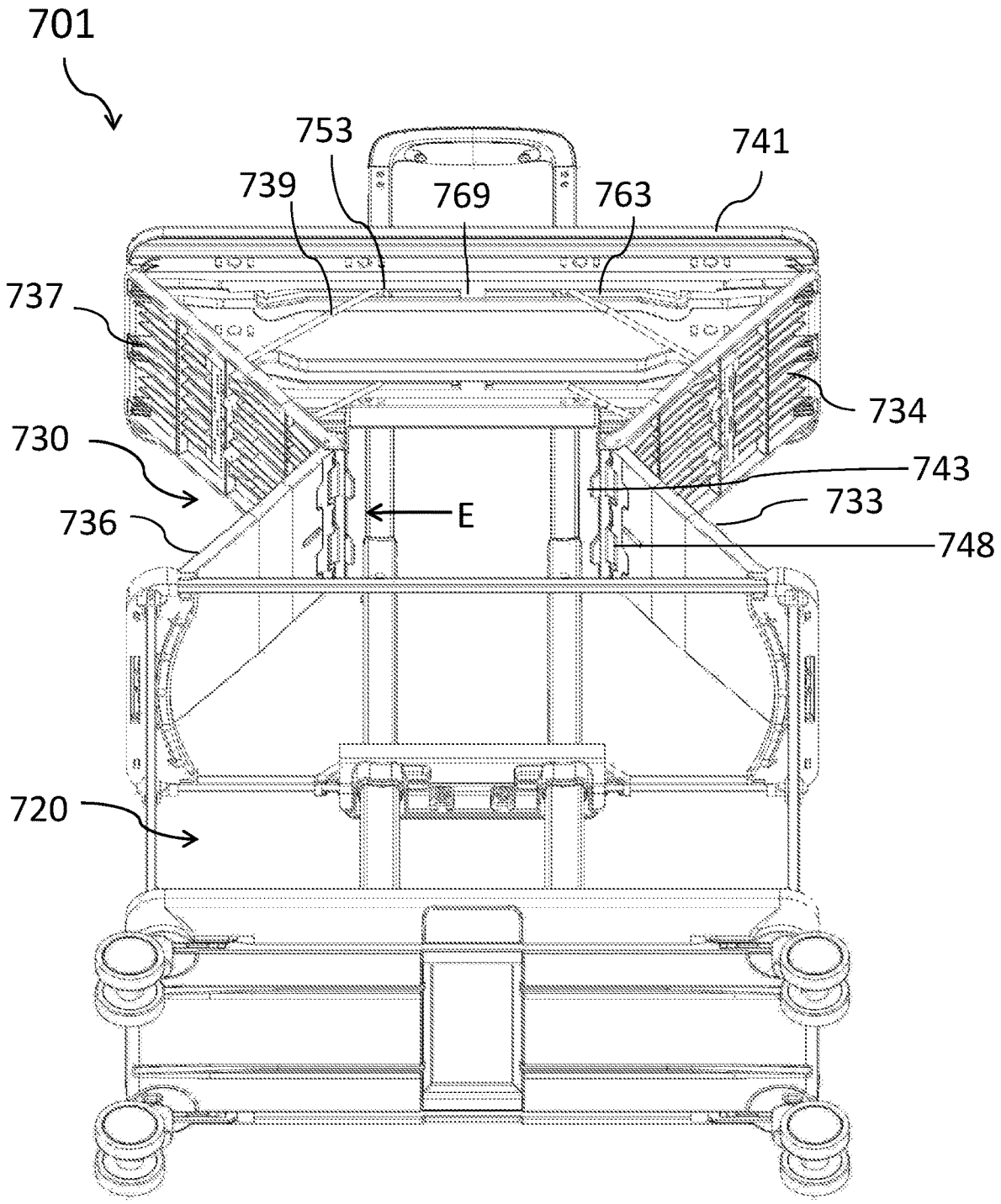
FIGS. 8B and 8C are a perspective view from below and from the front of the bag of 7A while its side walls are set to two folded configurations, respectively.

Engagement element 753 is shown in FIG. 8A to be in secured contact with a traversable obstacle 781 that is provided within the course of a corresponding groove 763. At this engagement element position that is achieved when compartment 730 is set to a fully expanded configuration, additional lengthwise displacement of engagement element 753 towards impediment 769 is prevented due to its engagement with obstacle 781. Through the secured contact between engagement element 753 and obstacle 781, supporting member 739 is able to function as a brace to resist unintentional collapse of the side walls of compartment 730.

After engagement element 753 becomes disengaged from obstacle 781, as will be described hereinafter, the side walls 733-734 and 736-737 are able to be unrestrainably folded. In response to the folding action of the side walls, supporting members 739 are slidably and continuously displaced along groove 763 to the positions shown in FIGS. 8B and 8C, which are closer to impediment 769. The displacement of a supporting member 739 along groove 763 is terminated when the corresponding engagement element 753 engages impediment 769, as shown in FIG. 8D, allowing the side walls to be fully folded.

Figure 8C:
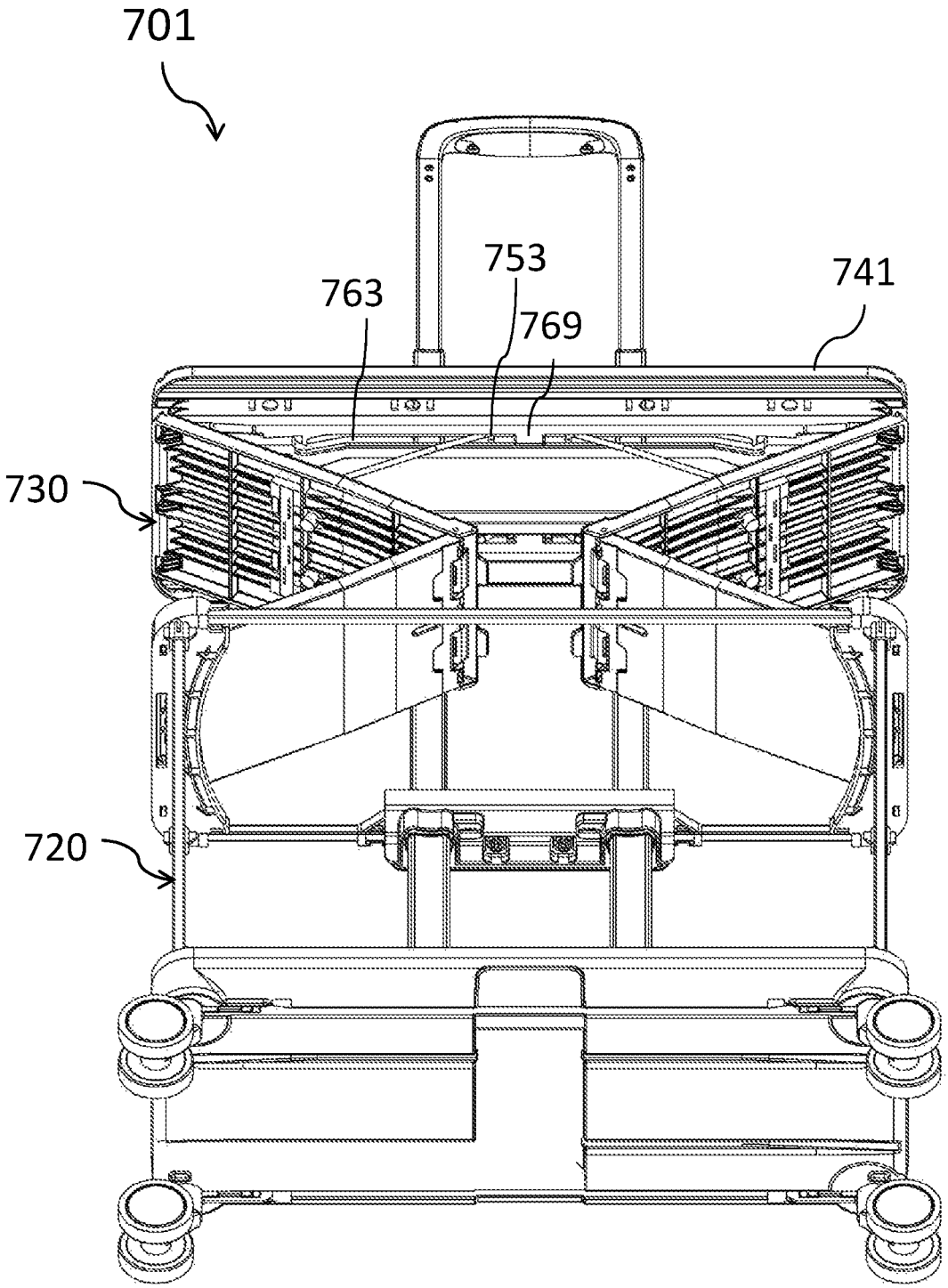
Figure 8D:
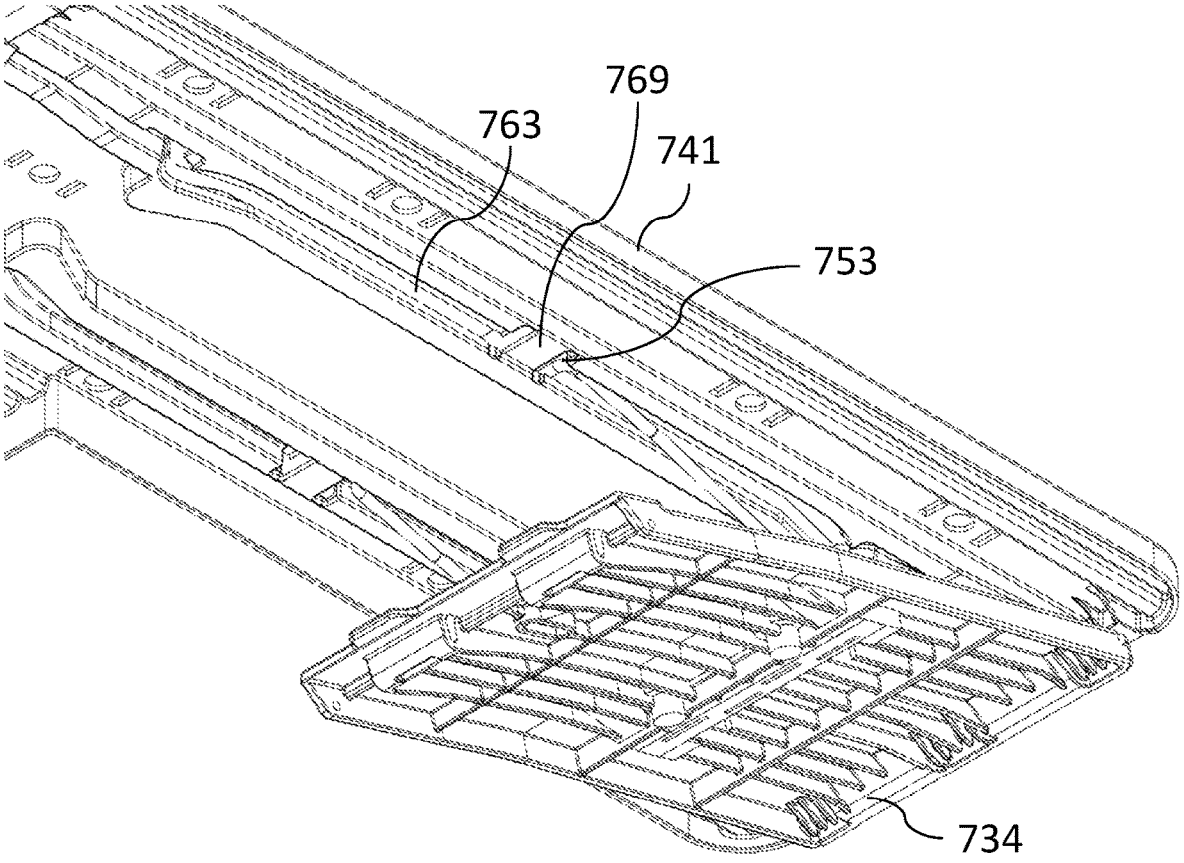
FIG. 8D is a bottom perspective view of the top wall panel of the bag of 7A, showing an engagement element engaged with a displacement terminating impediment.
Figure 8E:
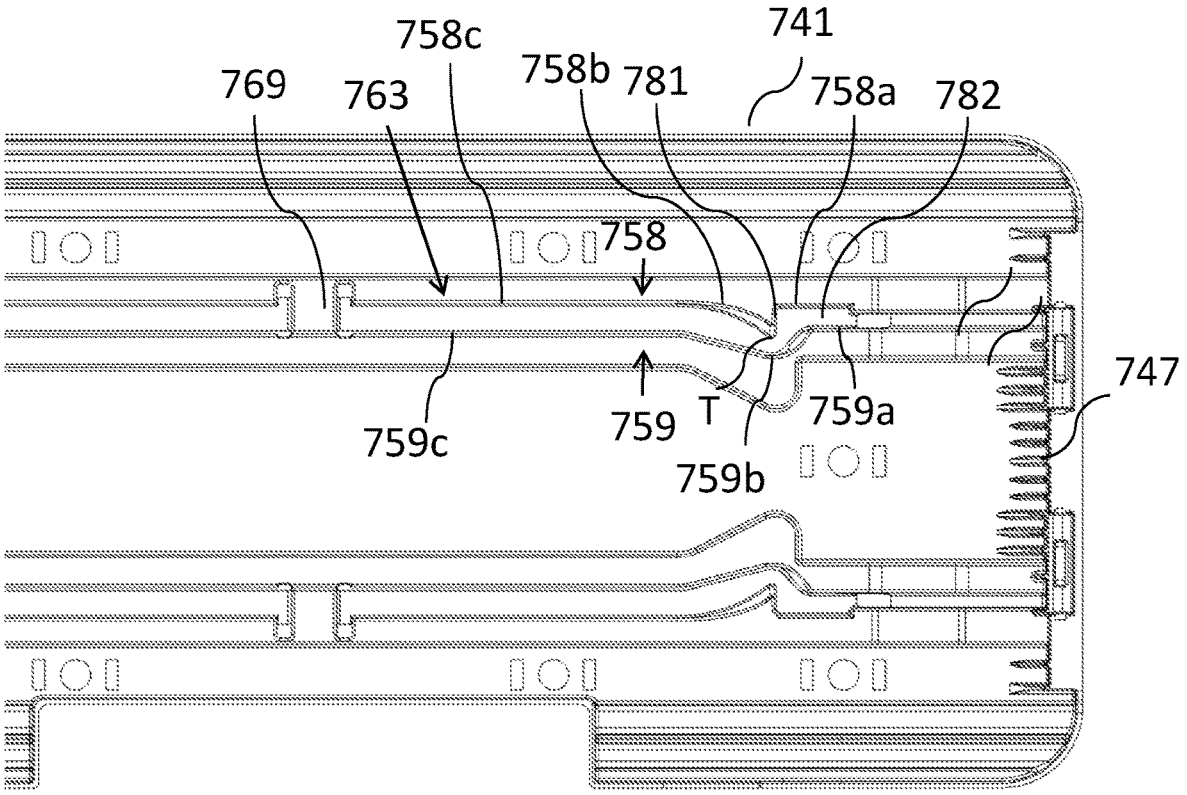
FIG. 8E is a bottom view of the top wall panel of FIG. 8D, showing an exemplary configuration of a groove along which an engagement element is displaceable.

A bottom view of top wall panel 741 is illustrated in FIG. 8E, showing an exemplary configuration of groove 763. Groove 763, defined by spaced lengthwise extending first wall 758 and second wall 759, is configured with a proximal cavity 782, i.e. in a direction towards spaced hinge elements 747 about which an upper compartment wall is able to pivot relative to top wall panel 741. The engagement element is receivable within proximal cavity 782 when the upper compartment is set to a fully expanded configuration. Planar obstacle 781, which is a portion of first wall 758, constitutes a distal planar wall of proximal cavity 782 that is perpendicular to the other first wall portion 758*a* of proximal cavity 782. A concave second wall portion 759*b* curvingly extends from the second wall portion 759*a* of proximal cavity 782 so as to be spaced from terminal edge T of obstacle 781 by a significantly smaller spacing than the spacing between first wall portion 758*a* and second wall portion 759*a*. Consequently, when the engagement element is in abutting relation with obstacle 781, distal sliding displacement of the corresponding pivoting supporting member is prevented.

A concave first wall portion 758*b* curvingly extends from terminal edge T of obstacle 781 to a straight first wall portion 758*c* that extends to impediment 769. Similarly, a straight second wall portion 759*c* extends continuously from concave second wall portion 759*b* to impediment 769, to facilitate the slidable displacement of the engagement element.

Figure 8F:
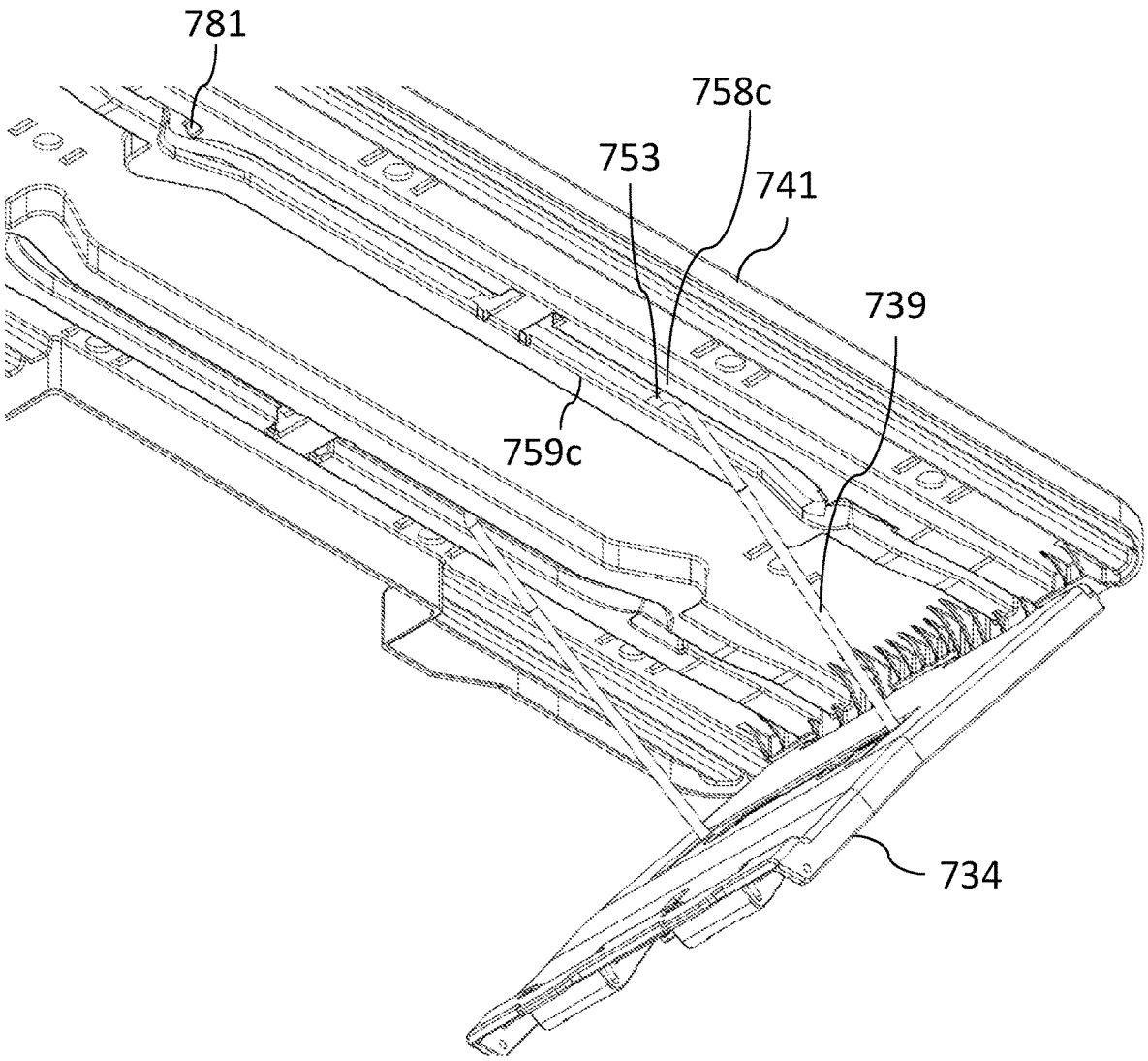
FIG. 8F is a bottom perspective view of the top wall panel of the bag of 7A, showing an exemplary configuration of an engagement element when positioned at an intermediate displaced position.

An exemplary hooked configuration of engagement element 753 is shown in FIG. 8F, such that its length is substantially equal to the spacing between straight first wall portion 758*c* and straight second wall portion 759*c* when hooked engagement element 753 being straight and angularly spaced relative to supporting member 739 is substantially perpendicular to straight first wall portion 758*c* and straight second wall portion 759*c* as shown. In order to traverse obstacle 781 even though its length is longer than the clearance between the concave second wall portion and the terminal edge of the obstacle, engagement element 753 is configured with resiliency, such as made from a springlike material or provided with a resilient element such as a spring. Accordingly when an actuating force is applied to engagement element 753, the latter yields during contact with the obstacle and becomes compressed. The compressed engagement element accordingly is able to traverse the clearance between the concave second wall portion and the terminal edge of the obstacle. After traversing the obstacle, engagement element 753 expands to its original length or original dimensions as shown.

The actuating force F shown in FIG. 8A that initiates a compartment collapsing operation may be a manual force applied to the engagement element from within the interior of the upper compartment, or alternatively may be transmitted to the engagement elements by means of an actuator, for example a mechanical or electrical actuator that is mounted on an external surface of the bag.

Similarly, an expanding force E shown in FIG. 8C that initiates a compartment expanding self-locking operation may be a manual force applied to one or more compartment side walls from within the interior of the compartment, or alternatively may be transmitted to the side walls by means of an actuator, for example a mechanical or electrical actuator that is mounted on an external surface of the bag. Transmission of expanding force E causes the engagement elements to be proximally displaced and to be temporarily compressed upon contacting the obstacle.

It will be appreciated that other configurations of an obstacle and engagement element are within the scope of the invention insofar as the engagement element is able to traverse the obstacle. For example, a first region of the obstacle urged to be in secured contact with the engagement element when the upper compartment is set to a fully expanded configuration may be solid and unyielding, and a second region of the obstacle may be configured with resilient means that allow the obstacle to be traversed when actuated.

The configuration of self-locking supporting members and a traversable obstacle may be implemented in a lower collapsible compartment or in a collapsible compartment positioned to the side of a fixed compartment.

Although embodiments of the invention have been described by way of illustration, it will be understood that the invention may be carried out with many variations, modifications, and adaptations, without exceeding the scope of the claims. For instance, the expandable apparatus may be kept in the top side of a bag rather than the bottom side, and the expanded receptacle may be added on to the top side of a bag, whereas the bottom side of the bag comprises a non-expandable receptacle.

The invention claimed is:

1. An expandable bag, comprising:

a) a base panel, wherein one or more pairs of lengthwise extending grooves are formed in an inner face of the base panel such that left and right grooves of each of the groove pairs are aligned with each other and are separated by an impediment located at an intermediate region of the base panel;

b) left and right collapsible side walls, each comprising first and second wall panels interconnected by at least one hinge, wherein the left and right first wall panels are pivotally connected, respectively, to left and right edges of the base panel and the left and right second wall panels are pivotally connected, respectively, to opposed frame elements of the bag, and wherein the expandable bag is reconfigurable from a collapsed configuration, in which the left and right side walls are collapsed, to an expanded configuration in which the left and right side walls are fully expanded and are substantially perpendicular to the base panel;

c) one or more pairs of pivoting supporting members configured to resist unintentional collapse of the left and right collapsible side walls, wherein each of the pivoting supporting members has an interconnecting portion pivotally connected to an intermediate region of a corresponding first wall panel and an engagement element slidably mounted in a corresponding groove of the groove pair so as to be continuously slidable along the corresponding groove in response to a degree of collapse of the left and right side walls until engaging the impediment; and d) a traversable obstacle provided along the corresponding groove, arranged such that additional lengthwise displacement of each of the engagement elements towards the impediment is prevented due to its secured collapse-resisting engagement with the obstacle when the bag is set to the expanded configuration, yet displacement of each of the engagement elements while traversing the obstacle along the corresponding groove is allowed when the bag is reconfigured from the expanded configuration to the collapsed configuration, wherein one of the engagement element and the obstacle is configured with resilient means which compress following transmission thereto of an actuating force, to facilitate displacement of the engagement element through a clearance between the obstacle and a wall of the corresponding groove that is smaller than a groove-engaging dimension of the engagement element when a corresponding pivotal supporting member is self-locked, wherein the corresponding groove is defined by spaced first and second walls and is configured with a proximal cavity within which the engagement element is receivable when the bag is set to the expanded configuration, the obstacle constituting a distal portion of the first wall of the cavity, wherein the obstacle is planar and is perpendicular to a lengthwise extending first wall portion of the cavity, wherein a concave second wall portion of the cavity curvingly extends from a lengthwise extending second wall portion of the cavity so as to be spaced from a terminal edge of the obstacle by a significantly smaller spacing than the spacing between the lengthwise extending first and second wall portions of the cavity.

2. The expandable bag according to claim 1, wherein a location of a center of gravity of the bag is unchanged following reconfiguration from the collapsed configuration to the expanded configuration.

3. The expandable bag according to claim 1, wherein the supporting members are pivotal props.

4. The expandable bag according to claim 3, wherein each of the pivotal props is self-locking.

5. The expandable bag according to claim 1, wherein the panels are made of Polypropylene.

6. The expandable bag according to claim 1, further comprising metal profiles at selected locations.

7. The expandable bag according to claim 1, further comprising an actuator for transmitting the actuating force to compress the resilient means and to initiate a bag collapsing or a bag expanding operation.

8. The expandable bag according to claim 1, further comprising a fixed compartment that includes the frame elements.

9. The expandable bag according to claim 8, wherein the fixed compartment is wheelable.

10. The expandable bag according to claim 1, further comprising at least one handle.

* * * * *